US012440737B2

(12) United States Patent
Biafore, Jr. et al.

(10) Patent No.: US 12,440,737 B2
(45) **Date of Patent: *Oct. 14, 2025**

(54) INTERCHANGEABLE GOLF CLUB GRIP WITH SHAFT ATTACHMENT SYSTEM

(71) Applicant: SSG International LLC, Wixom, MI (US)

(72) Inventors: John J. Biafore, Jr., Grand Blanc, MI (US); David Vergara, White Lake, MI (US); Dean Dingman, Brighton, MI (US)

(73) Assignee: SSG International LLC, Wixom, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/850,871

(22) Filed: Jun. 27, 2022

(65) Prior Publication Data

US 2022/0362643 A1 Nov. 17, 2022

Related U.S. Application Data

(63) Continuation of application No. 17/396,147, filed on Aug. 6, 2021, now Pat. No. 11,369,851.
(Continued)

(51) Int. Cl.
*A63B 53/14* (2015.01)
*A63B 60/06* (2015.01)
(Continued)

(52) U.S. Cl.
CPC ..... *A63B 60/14* (2015.10); *A63B 53/14* (2013.01); *A63B 60/16* (2015.10); *A63B 60/06* (2015.10); *A63B 60/08* (2015.10)

(58) Field of Classification Search
CPC ..... A63B 60/00; A63B 60/14; A63B 60/16; A63B 60/06; A63B 60/08; A63B 53/14
(Continued)

(56) References Cited

U.S. PATENT DOCUMENTS 3,810,502 A * 5/1974 Kyser ..... B25B 23/106 81/443
4,488,460 A 12/1984 Ballone et al.
(Continued)

FOREIGN PATENT DOCUMENTS

| | | |
|---|---|---|
| CN | 105377376 A | 3/2016 |
| WO | 2019103975 A1 | 5/2018 |
| WO | 2018222657 | 12/2018 |

OTHER PUBLICATIONS

International Search Report and Written Opinion for International Patent Application N. PCT/US2021/064607; dated Mar. 15, 2022; 12 pages.

*Primary Examiner* — John E Simms, Jr.
(74) *Attorney, Agent, or Firm* — Morgan, Lewis & Bockius LLP

(57) ABSTRACT

A golf club grip may include a docking tube and an elongated handle. The docking tube may be configured to couple to a golf club shaft and may include a docking tube sidewall. The elongated handle may be detachably couplable to the docking tube. The elongated handle may include an elongated handle sidewall defining an axial opening configured to receive the docking tube. At least one of the docking tube sidewall and the elongated handle sidewall may include a projection and the other of the docking tube sidewall and the elongated handle sidewall may include a channel. The channel may be configured to receive the projection to prevent rotation of the elongated handle relative to the docking tube when the elongated handle is coupled to the docking tube.

13 Claims, 33 Drawing Sheets

Related U.S. Application Data

(60) Provisional application No. 63/168,739, filed on Mar. 31, 2021, provisional application No. 63/128,460, filed on Dec. 21, 2020.

(51) Int. Cl.
*A63B 60/08* (2015.01)
*A63B 60/14* (2015.01)
*A63B 60/16* (2015.01)

(58) Field of Classification Search
USPC ..... 473/303
See application file for complete search history.

(56) References Cited

U.S. PATENT DOCUMENTS 4,671,511 A 6/1987 Trysinsky
4,826,168 A 5/1989 McGuire et al.
4,988,102 A * 1/1991 Reisner ..... A63B 60/24 473/297
5,299,802 A 4/1994 Bouchet-Lassale
5,364,102 A * 11/1994 Appledorn ..... A63B 53/007 473/297
5,478,074 A * 12/1995 Storper ..... A63B 53/14 473/299
5,730,662 A 3/1998 Rens
5,749,798 A * 5/1998 Kuebler ..... A63B 60/00 473/549
5,769,414 A 6/1998 Feche et al.
5,819,594 A * 10/1998 Sjovall ..... B62K 21/26 74/551.9
5,944,617 A * 8/1999 Falone ..... A63B 60/06 473/549
6,485,381 B1 * 11/2002 Pai ..... A63B 49/035 473/549
6,743,116 B2 6/2004 Wilbur
6,749,521 B1 6/2004 Benson
7,074,135 B2 7/2006 Moore
7,172,514 B2 2/2007 Benson
7,458,902 B2 12/2008 Gill
7,758,447 B2 7/2010 Sugimae
7,798,911 B2 9/2010 Gill
8,182,361 B2 5/2012 Gill
8,272,973 B2 9/2012 Lu
8,313,392 B2 11/2012 White
8,328,657 B1 12/2012 Demkowski et al.
8,348,783 B2 1/2013 Soracco et al.
8,419,566 B2 4/2013 Gill
8,425,344 B2 4/2013 Evans et al.
8,425,345 B2 4/2013 Wall, Jr. et al.
8,454,451 B2 6/2013 Evans
8,485,915 B2 7/2013 Evans
8,491,408 B2 7/2013 Beach et al.
8,529,367 B2 9/2013 Evans et al.
8,568,246 B2 10/2013 Wall et al.
8,591,350 B2 11/2013 Evans et al.
8,678,944 B2 3/2014 Wall, Jr.
8,740,720 B2 6/2014 Soracco
8,747,247 B2 6/2014 Beach et al.
8,758,155 B1 6/2014 Demkowski et al.
8,814,718 B1 8/2014 Rollinson et al.
8,814,719 B2 8/2014 Wall, Jr.
8,834,288 B2 9/2014 Aguinaldo et al.
8,852,019 B2 10/2014 Evans et al.
8,900,067 B2 12/2014 Beach et al.
9,138,623 B2 9/2015 Wall, Jr.
9,155,947 B2 10/2015 Aguinaldo et al.
9,174,104 B1 11/2015 Rogacki
9,216,334 B2 12/2015 Rollinson et al.
9,278,268 B2 3/2016 Pallis
9,375,619 B2 6/2016 Beach et al.
9,452,333 B1 9/2016 Chalifoux
9,586,108 B1 3/2017 Siniscalchi
9,586,114 B1 * 3/2017 Chalifoux ..... A63B 53/14
9,616,307 B1 * 4/2017 Chiang ..... A63B 53/14
9,656,138 B1 5/2017 Chalifoux
9,821,205 B2 11/2017 Chalifoux
9,889,357 B2 2/2018 Barker et al.
10,010,773 B1 7/2018 Pugliese
10,099,101 B1 10/2018 Dingman et al.
10,220,276 B2 3/2019 Knutson et al.
10,293,231 B2 5/2019 Breeden, III et al.
10,315,083 B1 6/2019 Moreira et al.
10,500,454 B2 12/2019 Barker
10,512,830 B2 12/2019 Nicolette et al.
10,525,316 B2 1/2020 Barker et al.
10,603,558 B2 3/2020 Dingman et al.
10,729,955 B2 8/2020 Knutson et al.
10,898,773 B2 1/2021 Barker et al.
10,987,559 B1 4/2021 Hamburger
11,369,851 B1 * 6/2022 Biafore, Jr. ..... A63B 60/48
2001/0011042 A1 8/2001 Roark
2002/0082103 A1 6/2002 Benson
2002/0173371 A1 11/2002 Lamkin et al.
2003/0148819 A1 * 8/2003 Lindner ..... A63B 60/24 473/316
2004/0025897 A1 * 2/2004 Menaged ..... B25G 1/00 132/150
2004/0242341 A1 * 12/2004 McDonald ..... A63B 53/14 473/303
2005/0143186 A1 6/2005 Blattner et al.
2006/0174440 A1 * 8/2006 Genoa ..... A47L 9/242 15/377
2007/0243947 A1 * 10/2007 Cheng ..... A63B 53/00 473/316
2008/0227562 A1 9/2008 Gill
2008/0274823 A1 11/2008 Lindner
2011/0081984 A1 * 4/2011 Beach ..... A63B 53/14 473/296
2011/0207546 A1 8/2011 Vitorino
2011/0300965 A1 12/2011 Gill
2012/0129624 A1 5/2012 Ito et al.
2012/0258817 A1 10/2012 Beach et al.
2013/0196769 A1 8/2013 Shocklee
2013/0344977 A1 * 12/2013 Chalifoux ..... A63B 53/14 473/299
2014/0342845 A1 * 11/2014 Dingman ..... A63B 60/16 473/297
2014/0378242 A1 12/2014 Chalifoux
2015/0231462 A1 * 8/2015 Chapin ..... A63B 60/16 473/300
2015/0251063 A1 * 9/2015 Dingman ..... A63B 53/14 473/297
2015/0306481 A1 * 10/2015 Knutson ..... A63B 60/00 473/296
2016/0016057 A1 * 1/2016 Wang ..... A63B 53/14 473/297
2016/0175669 A1 6/2016 Sin
2017/0304699 A1 * 10/2017 Johnson ..... A63B 53/14
2018/0147463 A1 * 5/2018 Breeden, III ..... A63B 53/14
2018/0154227 A1 * 6/2018 Barker ..... A63B 60/14
2018/0361214 A1 * 12/2018 Johnson ..... A63B 53/14
2020/0094119 A1 * 3/2020 Pugliese ..... A63B 60/22
2020/0122007 A1 4/2020 Barker et al.
2021/0138326 A1 5/2021 Barker et al.
2021/0346772 A1 * 11/2021 Miller ..... A63B 60/08
2022/0193511 A1 * 6/2022 Biafore, Jr. ..... A63B 53/14

* cited by examiner

INTERCHANGEABLE GOLF CLUB GRIP WITH SHAFT ATTACHMENT SYSTEM

CROSS-REFERENCE TO RELATED APPLICATIONS

This application is a continuation of U.S. patent application Ser. No. 17/396,147 filed Aug. 6, 2021, which claims the benefit of U.S. Provisional Patent Application No. 63/128,460 filed Dec. 21, 2020 and U.S. Provisional Patent Application No. 63/168,739 filed Mar. 31, 2021 entitled "Interchangeable Golf Club Grip with Shaft Attachment System", each of which are incorporated by reference herein in their entirety.

FIELD OF THE INVENTION

The present invention relates to a grip system and, in particular, golf club grips with a shaft attachment system for securing a replacement grip to a golf club shaft.

BACKGROUND OF THE INVENTION

A wide variety of golf club grips are permitted by the relevant governing bodies for professional and amateur golf. Most golf clubs are provided by the manufacturer with a stock golf club grip already installed. These golf club grips are typically made of rubber or a synthetic material meant to simulate rubber. An outer wrap of leather or leather-like material can be implemented to add diameter to the grip and give it its basic profile.

Accordingly, there remains a continued need for an improved system for securing replacement grips onto golf club shafts, and in particular, replacement grips that can be quickly secured to a wide variety of tapered golf club shafts without requiring professional assistance.

SUMMARY OF THE INVENTION

A golf club grip may include a docking tube and an elongated handle. The docking tube may be configured to couple to a golf club shaft and may include a docking tube sidewall. The elongated handle may be detachably couplable to the docking tube. The elongated handle may include an elongated handle sidewall defining an axial opening configured to receive the docking tube. At least one of the docking tube sidewall and the elongated handle sidewall may include a projection, and the other of the docking tube sidewall and the elongated handle sidewall may include a channel. The channel may be configured to receive the projection to prevent rotation of the elongated handle relative to the docking tube when the elongated handle is coupled to the docking tube.

The docking tube may comprise a hollow structure configured to receive the golf club shaft. The projection may be one of a plurality of projections on the at least one of the docking tube sidewall and the elongated handle sidewall. The docking tube sidewall may include the plurality of projections, and an intermediate section of the docking tube sidewall may interconnect a first projection of the plurality of projections and a second projection of the plurality of projections. The intermediate section of the docking tube sidewall may define a radius of curvature greater than a radius of curvature defined by at least one of the plurality of projections.

In a further embodiment, the docking tube sidewall may include the projection and the docking tube may include a plurality of ribs extending at least partially along an exterior of the docking tube sidewall. The projection may be bordered by two ribs of the plurality of ribs. One rib of the plurality of ribs and the projection may have different cross-sectional shapes when viewed from a proximal end of the docking tube. The projection and two ribs of the plurality of ribs may be configured to be received in the channel when the elongated handle is coupled to the docking tube.

In a further embodiment, an insert may be received within an end portion of the docking tube. The insert may include a shank having external threads, a head that may be wider than the shank, and an internally threaded bore. A weighted insert may be threadedly engageable with the internally threaded bore of the insert. A ring insert may be positionable within an opening in an end of the elongated handle. The ring insert may include an engagement surface configured to engage a weighted end cap. The ring insert may include a chamfered annular surface opposite the engagement surface.

The elongated handle may include an underlisting and an outer gripping surface. The elongated handle may include a proximal end and a distal end with a portion of the docking tube extending distally beyond the distal end of the elongated handle when the elongated handle is coupled to the docking tube. A docking sleeve may surround the portion of the docking tube that extends distally beyond the distal end of the elongated handle.

The docking tube sidewall may define a generally circular cross-section when viewed from a proximal end of the elongated handle. The elongated handle may include the channel, and the channel may be one of a plurality of channels, the plurality of channels being disposed in a radially asymmetric arrangement about a centerline axis of the axial opening.

The projection may be one of a plurality of projections and each of the plurality of channels may be configured to receive a different one of the plurality of projections when the elongated handle is coupled to the docking tube. The docking tube sidewall may include the projection, and the projection may be outwardly convex.

A further embodiment may include an elongated handle for attachment to a docking tube having protrusions. The elongated handle may include an outer gripping surface and an underlisting. The underlisting may define an axial opening including an annular surface and a plurality of longitudinal channels. The plurality of longitudinal channels may be recessed relative to the annular surface and disposed about a centerline axis of the elongated handle. The plurality of longitudinal channels may be configured to receive the protrusions of the docking tube such that the elongated handle is prevented from rotating with respect to the docking tube about the centerline axis.

The plurality of longitudinal channels may have a generally rectangular cross-section when viewed from a proximal end of the elongated handle. The plurality of longitudinal channels may define a uniform width and a uniform depth. The uniform width may be greater than the uniform depth. The plurality of longitudinal channels may include five channels. The plurality of longitudinal channels may be disposed in a radially asymmetric arrangement about the centerline axis of the elongated handle such that the docking tube can be received in the axial opening in only a single orientation.

A butt end of the elongated handle may include a stepped opening, and the elongated handle may further include a ring insert that may be seated within the stepped opening in the butt end of the elongated handle. The ring insert may include a flat engagement surface to detachably receive a weighted end cap. The ring insert may include a chamfered annular surface opposite of the flat engagement surface.

A method of securing a golf club grip to a golf club may include positioning an elongated handle on a docking tube such that the docking tube is received in an axial opening of the elongated handle. The docking tube may be coupled to a golf club shaft. At least one of the docking tube and the elongated handle may include a projection and the other of the docking tube and the elongated handle may include a channel and positioning the elongated handle on the docking tube may include positioning the projection in the channel such that the elongated handle is rotationally fixed relative to the docking tube.

In a further embodiment, the method may include securing the docking tube to the golf club shaft, thereby rotationally fixing the docking tube to the golf club shaft.

The docking tube may be rotationally fixed relative to the golf club shaft and positioning the elongated handle on the docking tube includes rotationally fixing the elongated handle relative to the golf club shaft. Positioning the elongated handle on the docking tube may include moving the elongated handle relative to the docking tube from an initial position when the elongated handle first engages the docking tube to a final position. The elongated handle may be rotationally fixed relative to the docking tube as the elongated handle is moved from the initial position to the final position.

In a further embodiment, the method may include detaching the elongated handle from the docking tube and positioning a second elongated handle on the docking tube. The docking tube may remain secured to the golf club shaft while detaching the elongated handle from the docking tube.

An interchangeable golf club grip with a shaft attachment system is provided. In one embodiment, the shaft attachment system includes a docking tube positioned within an axial opening in the golf club grip. The docking tube includes multiple lengthwise projections, each being positioned within a corresponding channel in the golf club grip to prevent relative rotation between the golf club grip and the docking tube. When press-fit over a golf club shaft, the docking tube sidewall securely conforms to the outer diameter of the golf club shaft, despite the golf club shaft having an outer diameter that varies along all or a portion of its length.

In one embodiment, each lengthwise projection is a raised portion of the docking tube sidewall and is outwardly convex. Each lengthwise projection is optionally bordered by two longitudinal ribs that extend parallel to each other. In this embodiment, one lengthwise projection and two longitudinal ribs are received within a channel in an underlisting. Multiple channels may be disposed asymmetrically about the centerline axis of the underlisting, such that docking tube can be received in the axial opening of the golf club grip with only a single orientation.

In another embodiment, the docking tube includes a sidewall defining a polygonal cross-section, for example, a hexagonal cross-section or an octagonal cross-section. The longitudinal ribs are aligned with the corner portions of the polygonal cross-section, and the sidewall is outwardly concave between adjacent corners. The outwardly concave sidewall can flex outwardly when the docking tube is press-fit over the golf club shaft. The docking tube thereby provides an interference fit with the golf club shaft along its entire length.

In another embodiment, the docking tube includes an elongated channel defining an open cross-section. The elongated channel is tube-shaped except for a lengthwise gap that extends along the entirety of the length of the elongated channel. The elongated channel is formed from an elastically deformable material to flex radially outwardly and fit over a golf club shaft. The inner surface of the golf club grip and the outer surface of the elongated channel include interengaging surfaces that prevent relative rotation therebetween. The inner surface of the elongated channel is optionally coated with a friction material to resist rotation of the golf club shaft therein.

In still another embodiment, the shaft attachment system further includes a lower clamp assembly having a resilient skirt and a ring clamp. The resilient skirt is joined to the docking tube and extends from the axial opening in the golf club grip. The resilient skirt includes multiple flanges, each of the flanges including a friction surface. The ring clamp fits over the resilient skirt and includes multiple cams for engaging the flanges, such that rotation of the ring clamp relative to the resilient skirt biases the friction surface of each of the flanges inwardly to secure the golf club grip to the golf club shaft. Rotation of the ring clamp can be reversed to unlock the resilient skirt, without the use of hand tools, if removal of the golf club grip is desired.

In yet another embodiment, the lower clamp assembly includes a removable installation tool for a compression clamp as part of a lower clamp assembly. The removable installation tool includes an inverted U-shaped yoke extending partially around the compression clamp and a screw extending through the base of the yoke and oriented to engage a gap between spaced apart portions of the compression clamp. Rotation of the screw relative to the yoke causes the screw tip to lower into this gap, which in turn causes the compression clamp to expand. Once expanded, the compression clamp can be freely guided over the docking tube during installation of the golf club grip and during removal of the golf club grip. The compression clamp is therefore a binary clamping system that provides a non-adjustable clamping force during play.

The golf club grip is optionally a widened grip, in particular a replacement golf club grip for a putter. The golf club grip further optionally includes a generally rectangular cross-section with a central axis that generally coincides with the axis of the golf club shaft. The rectangular cross-section is sufficiently widened to permit a forward-facing surface of the golf club grip (in the heel-to-toe direction) to function as a point of engagement for left and right thumbs. The golf club grip is easily mounted and dismounted to a golf club shaft with minimal or no hand tools, thereby providing a customized grip that is held in position along the length of the golf club grip despite the golf club shaft having a tapered outer diameter.

These and other features and advantages of the present invention will become apparent from the following description of the invention, when viewed in accordance with the accompanying drawings and the appended claims.

DETAILED DESCRIPTION OF THE EXEMPLARY EMBODIMENTS OF THE INVENTION

Figure 1:
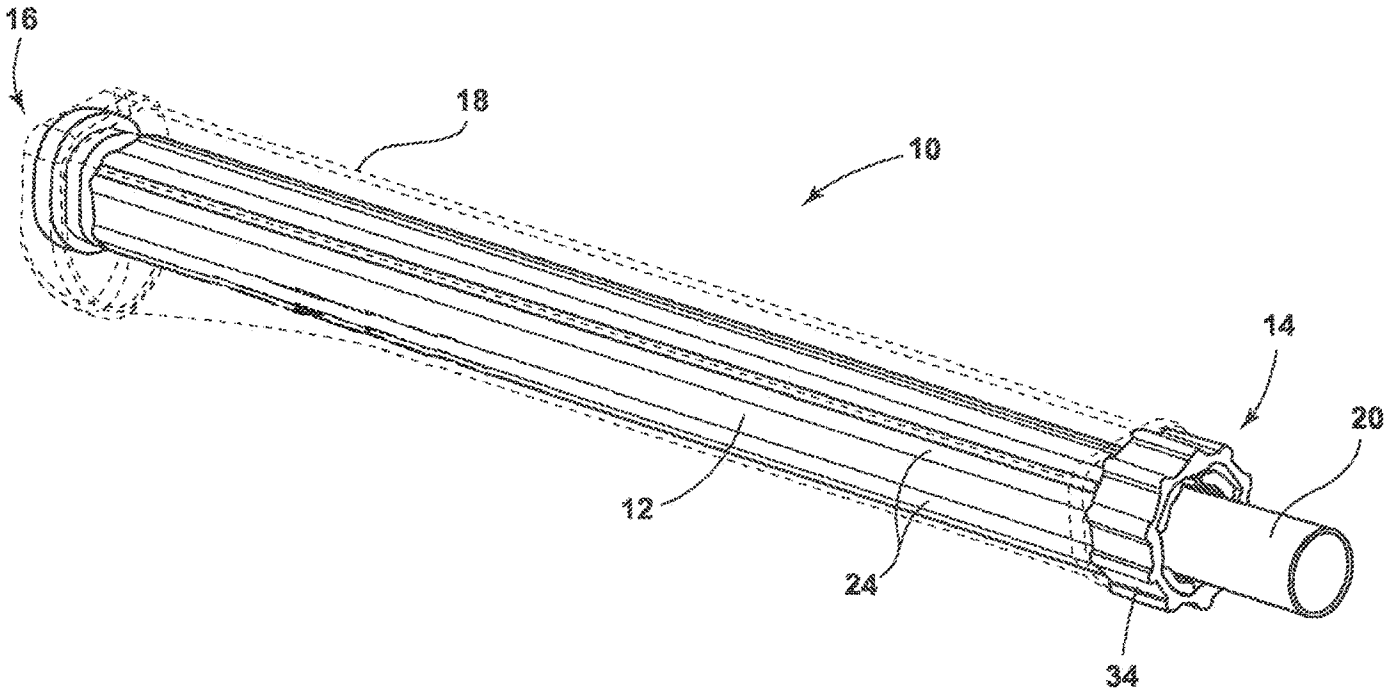
FIG. 1 is a perspective view of a golf club grip in accordance with a first embodiment of the present invention.

The current embodiments generally relate to a replacement golf club grip having a shaft attachment system. The shaft attachment system includes one or more of the following features, alone or in combination, to secure a golf club grip to tapered and non-tapered golf club shafts: a docking tube, a lower clamp assembly, and an upper clamp assembly. While illustrated in connection with a widened putter grip, the shaft attachment system can also be used in connection with conventional grips for woods, irons, hybrids, and drivers, for example. The grip system may also be used in connection with other devices. For example, the grip system may be used with construction equipment (e.g., shovel, pick, axe, hammer, trowel, power tool) or athletic equipment for other sports (e.g., tennis, badminton, racquetball, squash).

A golf club grip 10 having a shaft attachment system in accordance with a first embodiment is illustrated in FIGS. 1-4 and generally designated 10. The golf club grip 10 includes a docking tube 12, a lower clamp assembly 14, and an upper clamp assembly 16 (visible in FIG. 2). As explained below, the docking tube 12 is bonded to the interior of an underlisting 18 and is press-fit over a golf club shaft 20 to provide an interference fit between the underlisting 18 and golf club shaft 20. In some embodiments, the docking tube 12 is integrated into the golf club shaft 20 rather than press-fit onto the shaft 20. The lower clamp assembly 14 is adapted to secure the base of the golf club grip 10 to the shaft 20 and the upper clamp assembly 16 is adapted to secure the top of the golf club grip 10 to the shaft 20. Each such feature is separately described below.

Figure 2:
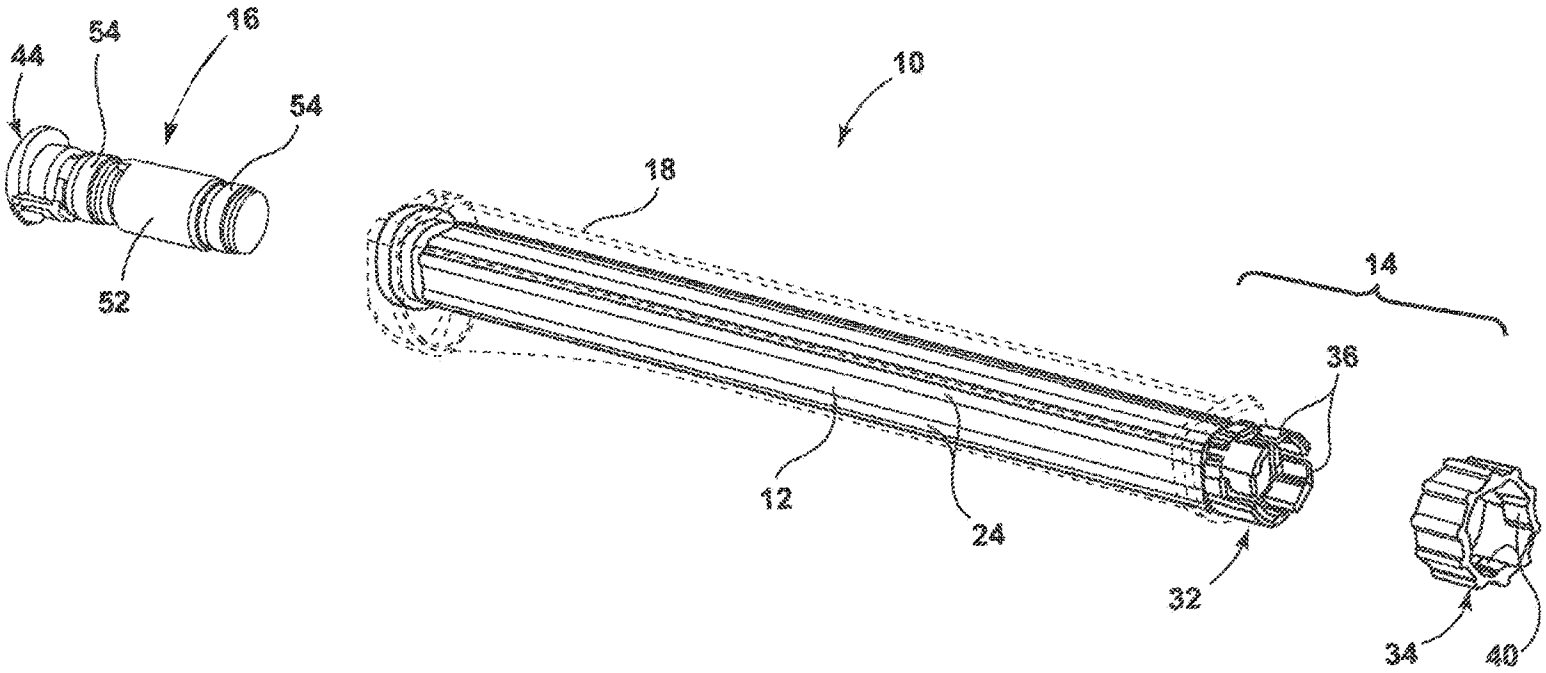
FIG. 2 is an exploded perspective view of the golf club grip of FIG. 1.
Figure 3:
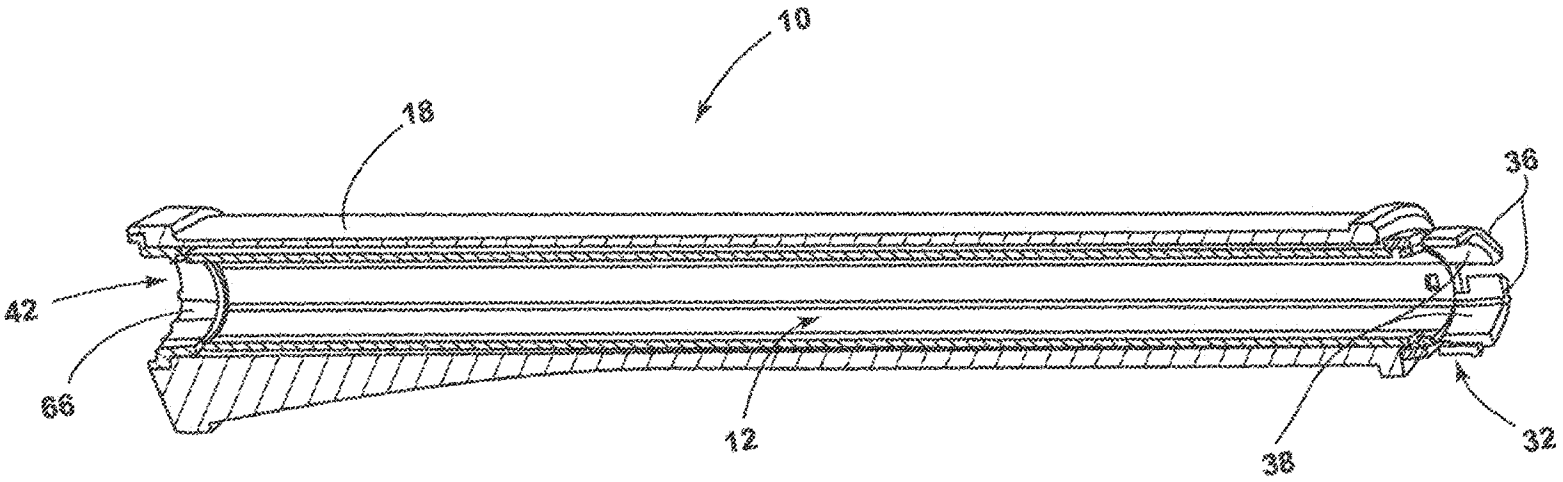
FIG. 3 is a longitudinal cross-sectional view of the golf club grip of FIG. 1.
Figure 4:
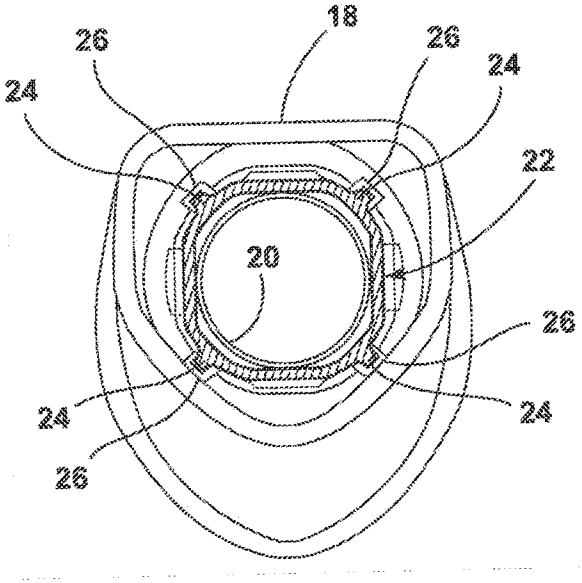
FIG. 4 is a lateral cross-sectional view of the golf club grip of FIG. 1.

The docking tube 12 comprises the innermost portion of the golf club grip 10 and generally includes a uniform cross-section along its entire length. The docking tube 12 includes an elastically deformable sidewall 22 defining a closed hollow structure, optionally having a polygonal cross-section. In other embodiments, the docking tube 12 defines an open structure (e.g., having a C-shaped cross-section). As shown in FIGS. 2 and 4, the docking tube 12 further includes a plurality of longitudinal ribs 24 protruding from an outward facing surface of the elastically deformable sidewall 22.

The longitudinal ribs 24 are positioned within corresponding grooves 26 in the underlisting 18 to prevent relative rotation between the underlisting 18 and the docking tube 12. In an unstressed state, the portions of the sidewall 22 between the longitudinal ribs 24 (termed "intermediate portions" herein) include a reduced inner diameter as shown in FIG. 4. The intermediate portions 28 are the first to engage the golf club shaft 20 and flex outwardly to extend over the widest portion of the golf club shaft 20. Because the intermediate portions 28 are elastically deformable, the intermediate portions 28 contract after passing over the top of the golf club shaft 20 and continue to engage the golf club shaft 20 along the length of the golf club grip 10. The docking tube 12 is formed from a resilient, flexible thermoplastic in the current embodiment—for example, thermoplastic polyurethane (TPU)—but can be formed from other materials in other embodiments.

In the embodiment of FIGS. 1-4, the docking tube 12 includes four longitudinal ribs 24 that are spaced at 90-degree intervals about the enclosed sidewall 22. In other embodiments, however, greater or fewer longitudinal ribs 24 can be used. As shown in FIG. 7A, for example, the docking tube 12 can include six longitudinal ribs 24 or eight longitudinal ribs 24.

Figure 7C:
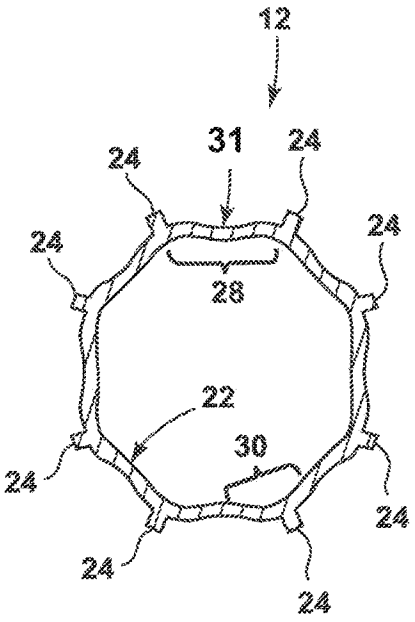
FIGS. 7A-7C depict cross-sections of different embodiments of a docking tube in accordance with the present invention.
Figure 7B:
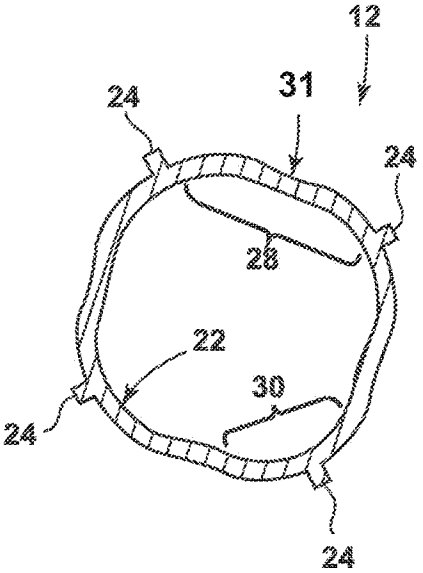
Figure 7A:
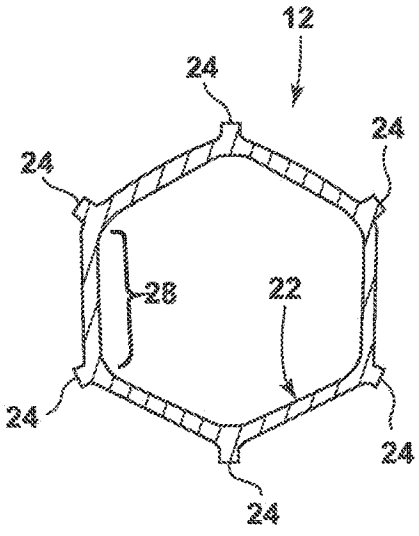

As further shown in FIGS. 7A-7C, the sidewall 22 includes a thin-walled polygonal cross-section having rounded corner portions 30, such that the intermediate portions 28 are outwardly concave. The outwardly concave intermediate portions 28 define a radially deformable relief 31 between adjacent corner portions 30. Each radially deformable relief 31 can invert and flex outwardly when the docking tube 12 is press-fit over the golf club shaft 20. As noted above, the radially deformable intermediate portions 28 are the first to engage the golf club shaft 20 and flex outwardly to maintain continuous contact with the golf club shaft 20. In some embodiments, the outer diameter of the golf club shaft 20 will vary along the length of the golf club grip 10. The radially deformable intermediate portions 28 expand outwardly to fit over the widest portion of the golf club shaft 20 and contract inwardly as the golf club grip 10 slides down the shaft 20 into the position shown in FIG. 8. Throughout this process, a clearance exists between the golf club shaft 20 and the corner portions 30 of the docking tube 12. The golf club grip 10 is also well suited for use with nontapered golf club shafts, including putter shafts, for example, being secured to the nontapered golf club shaft by interference fit substantially as set forth above.

Referring again to FIGS. 1-3, the golf club grip 10 includes a lower clamp assembly 14 to secure the base of the golf club grip 10 to the shaft 20. The lower clamp assembly 14 includes a resilient skirt 32 and a ring clamp 34. The resilient skirt 32 is joined to the docking tube 12, optionally being glued to the docking tube 12. In other embodiments the resilient skirt 32 is joined to the underlisting 18. The resilient skirt 32 includes a plurality of flexible flanges 36, each of the flanges including an inward-facing friction surface 38. Each friction surface 38 is formed from thermoplastic rubber (TPR) in the present embodiment but can be formed from other materials in other embodiments. The flanges 36 extend in the longitudinal direction, being curved to extend partially around the golf club shaft 20. As shown in FIG. 2, the ring clamp 34 fits over the skirt 32 and includes multiple cams 40 for engaging an outer radial surface of the flanges 36 while also concealing the flanges 36 from view. The ring clamp 34 includes a cam 40 for each flange 36 of the skirt 32. The cams 40 are spaced apart from each other to fit between adjacent flanges 36 during installation of the ring clamp 34 over the skirt 32. Rotation of the ring clamp 34 relative to the skirt 32 causes each cam 40 to engage a corresponding flange 36 to bias the friction surface 38 inwardly and lock the base of the golf club grip 10 onto the golf club shaft 20. Rotation of the ring clamp 34 can be reversed to unlock the resilient skirt 32, without the use of hand tools, if removal of the golf club grip 10 is desired. In embodiments in which an increased locking force is desired, the surface area of the friction surfaces 38 can be increased by lengthening the flanges 36 or by using a hand tool that provides a leveraging action to the ring clamp 34.

Figure 5:
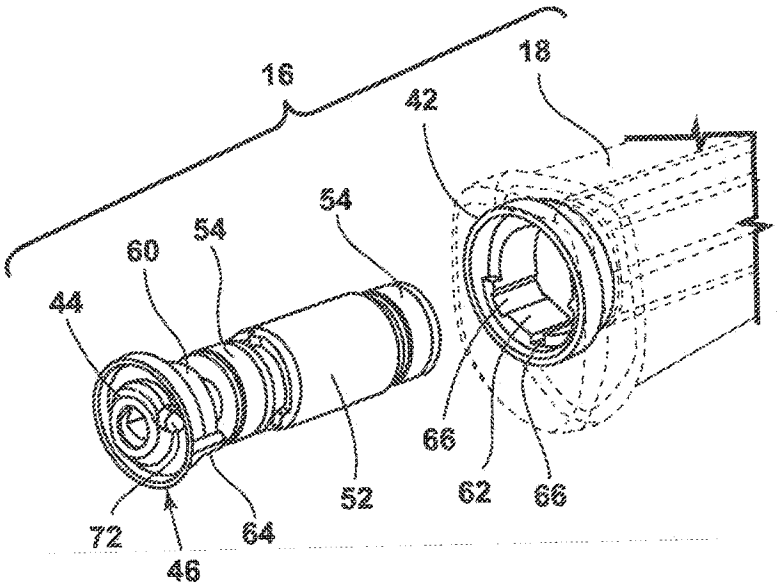
FIG. 5 is a close-up exploded view of a portion of the golf club grip of FIG. 1.
Figure 6:
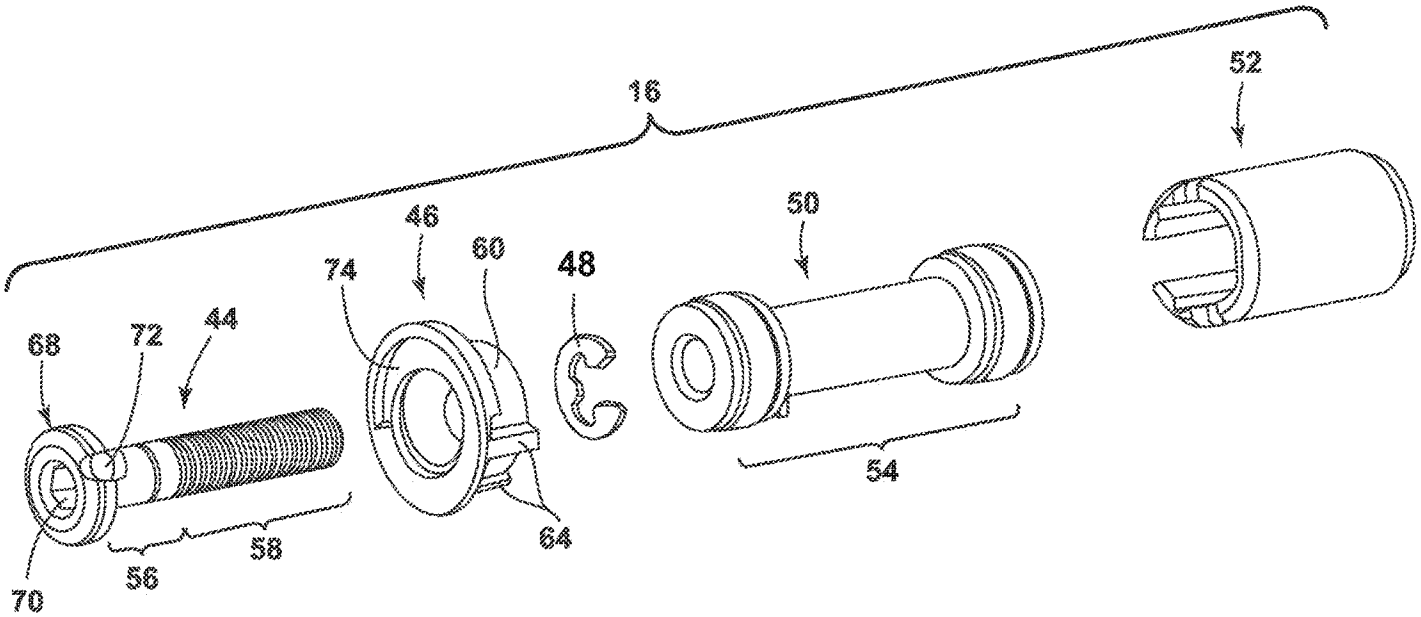
FIG. 6 is an exploded view of the upper clamp assembly of FIG. 5.

Referring to FIGS. 5-6, the golf club grip 10 also includes an upper clamp assembly 16. The upper clamp assembly 16 is shaped to be received within a guide cap 42, the guide cap 42 being adhered to the underlisting 18 to prevent relative rotation. As best shown in FIG. 6, the upper clamp assembly 16 includes a bolt 44, a cam nut 46, a washer 48, an inner sleeve 50, and an outer sleeve 52. As discussed below, the outer sleeve 52 is not concentric to the inner sleeve 50. Consequently, rotating the inner sleeve 50 causes the outer sleeve 52 to move away, increasing the overall diameter of the upper clamp assembly 16. The bolt 44 is threaded for engaging corresponding threads in the interior of the inner sleeve 50. The inner sleeve 50 includes a tubular body having first and second annular channels for first and second TPR overmoldings 54. The outer sleeve 52 fits over the inner sleeve 50, between the TPR overmoldings 54, and includes an outer diameter that closely matches the inner diameter of the golf club shaft 20 so that the golf club shaft 20 tightly surrounds the outer sleeve 52.

As also shown in FIG. 6, the bolt 44 includes a shank 56 positioned above the threads 58, the shank 56 being inserted within the cam nut 46. The cam nut 46 is not internally threaded, and instead includes an outer radial surface 60 having a nonuniform outer diameter that is keyed with the nonuniform inner diameter of the inner radial surface 62 of the guide cap 42. In the current embodiment, the outer radial surface 60 of the cam nut includes three ribs 64 that are received within corresponding slots 66 in the guide cap 42, the ribs 64 being disposed asymmetrically about the exterior of the cam nut 46 to ensure that the guide cap 42 accepts only a single orientation of the cam nut 46. The washer 48 is positioned between the cam nut 46 and the inner sleeve 50 when the bolt 44 is threaded into the inner sleeve 50. Of note, the bolt head 68 includes an opening 70 for a hex tool but can accommodate other implements in other embodiments. The bolt head 68 also includes a finger element 72 that is received within an annular recess 74 in the cam nut 46. The cam nut 46 can be aligned with the keyed opening in the guide cap 42 and, once inserted therein, the bolt 44 can be manually rotated clockwise to lock the upper clamp assembly 16 in place in the golf club grip 10 and manually rotated counter-clockwise to unlock the upper clamp assembly 16 for removal. Rotation of the inner sleeve 50 in the clockwise (or counterclockwise) direction causes the outer sleeve 52 to expand radially outwardly, which results in an increased outer diameter of the upper clamp assembly 16. The outer surface of the outer sleeve 52 binds against the inner surface of the golf club shaft 20 to lock the upper clamp assembly 16, and consequently the grip 10, to the inside of the golf club grip. Similarly, rotation of the inner sleeve 50 in the counterclockwise (or clockwise) direction causes the outer sleeve 52 to contract radially, which releases pressure against the inner surface of the golf club shaft 20 to unlock the upper clamp assembly 16. The upper clamp assembly 16 is optional, however. Other embodiments may include no upper clamp assembly or may include a conical plug or other centering means, discussed below.

Figure 8:
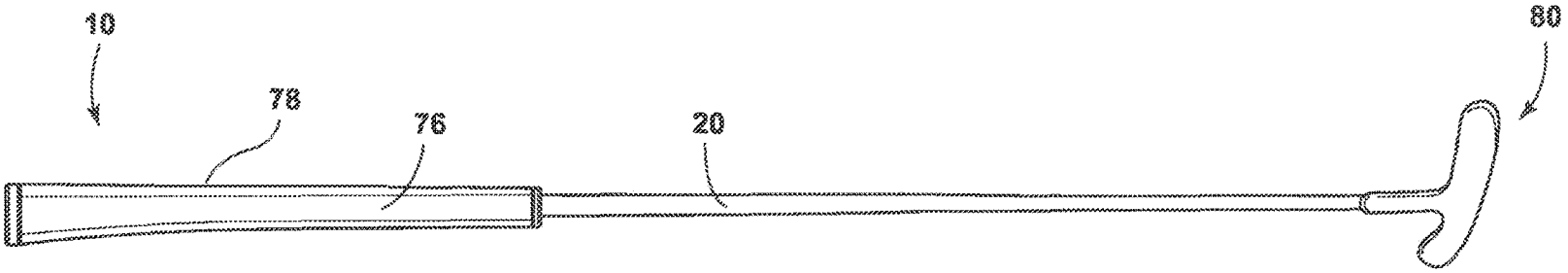
FIG. 8 is a side view of the club grip of FIG. 1 secured to a putter shaft.

The golf club grip 10 also includes a gripping surface 76 of any suitable material—including natural rubber, silicon rubber, or plastic, for example—generally having a lower durometer than the underlisting 18. The gripping surface 76 is a molded monolithic element in the current embodiment, optionally a molded EVA sleeve that extends over the underlisting 18. In some embodiments, the underlisting 18 provides a seating surface to which the softer gripping surface 76 is directly molded. In other embodiments, the underlisting 18 and the gripping surface 76 are integrally formed with one another and comprise a single element of an elongated outer handle for the golf club grip 10. As also shown in FIG. 8, the golf club grip 10 can comprise a putter grip. The golf club grip 10 is illustrated as a widened grip having a forward-facing surface 78 (in the heel-to-toe direction) to function as a point of engagement for left and right thumbs. The head 80 may be any conventional putter head formed of aluminum, brass, or other material, and has a front toe, rear heel, flat striking face, and top surface. The shaft 20 is a tapered steel tube in the illustrated embodiment but can be formed from graphite or other materials in other embodiments. The shaft has an upper end, which is covered by the grip 10, and a lower end, which is joined to the head 80.

The golf club grip 10 can be attached to a tapered shaft 20 in the following manner. The ring clamp 34 is loosely inserted over the shaft 20, and the shaft 20 is then press-fit into the docking tube 12. The docking tube sidewall 22 (at this point being glued to the interior of the golf club grip 10) engages the shaft 20 and flexes outwardly as the widest portion of the shaft 20 passes through the docking tube 12. Because the sidewall 22 is elastically deformable, it can accommodate various diameters, including the tapered outer diameter of the golf club shaft 20, which can vary by as much as 6 mm or more along the length of the golf club grip 10. The docking tube sidewall 22 conforms to the outer diameter of the golf club shaft 20, despite the golf club shaft 20 having an outer diameter that varies along its length. With the golf club grip 10 properly aligned, the ring clamp 34 is brought into engagement with the resilient skirt 32 and rotated clockwise until the cams 40 engage the flexible flanges 36, bringing the friction surfaces 38 into engagement with the golf club shaft 20. At the upper end of the golf club grip 10, the upper clamp assembly 16 is fully inserted into the guide cap 42. The bolt 44 is then rotated clockwise through a range of about 180 degrees to lock the upper clamp assembly 16 in place in the golf club grip 10. The foregoing steps can be repeated in the reverse order if replacement of the golf club grip 10 is desired, or if the same golf club grip 10 is desired for another golf club.

Figures 9A, 9B, 9C:
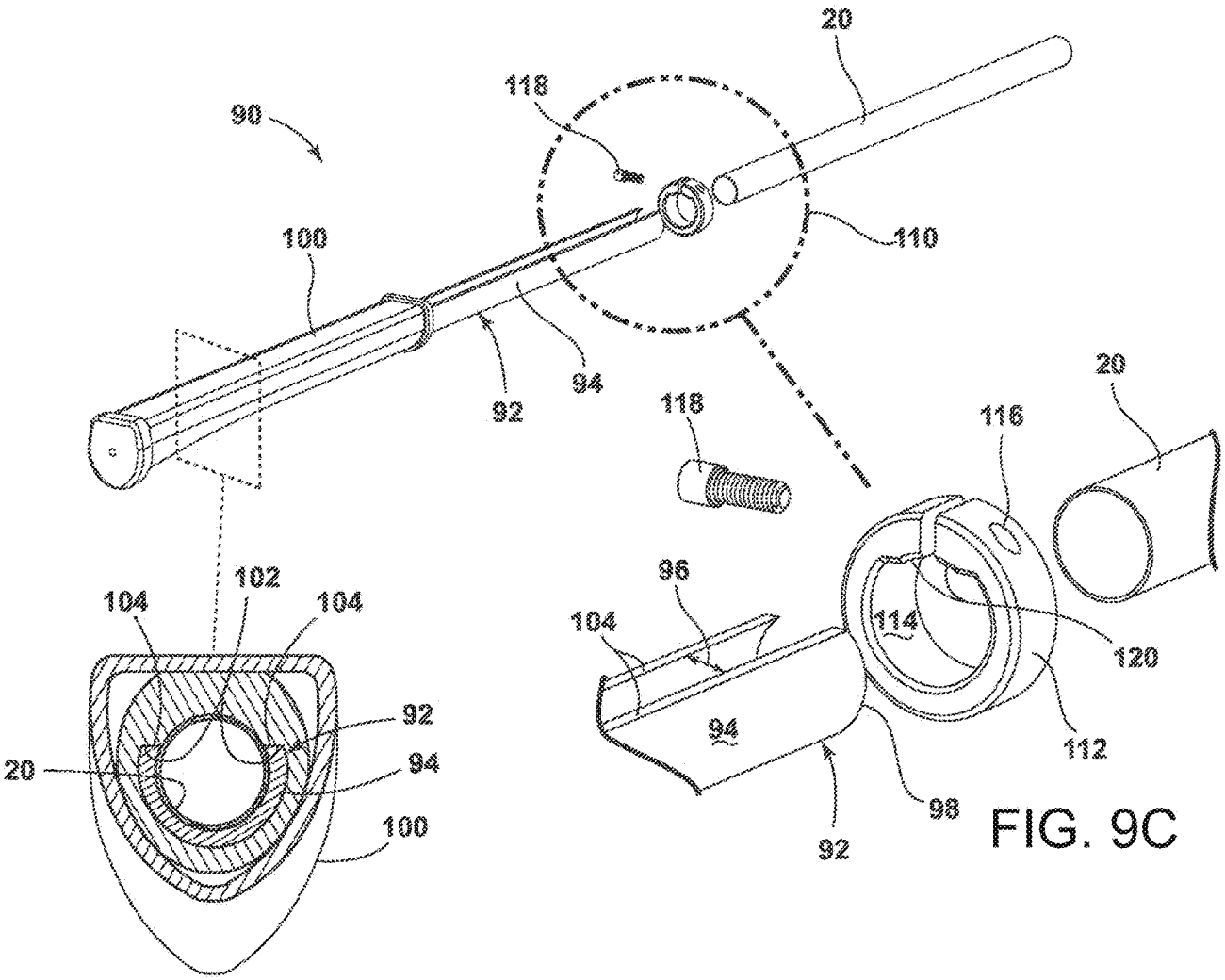
FIG. 9A is a perspective exploded view of a golf club grip of a second embodiment of the present invention.
FIG. 9B is a sectional view of the golf club grip of FIG. 9A.
FIG. 9C is an enlarged view of a portion of the golf club grip of FIG. 9A

Referring to FIGS. 9A-9C, a golf club grip in accordance with a second embodiment is illustrated and generally designated as golf club grip 90. The golf club grip 90 of FIG. 9A is similar in structure and function to the golf club grip 10 of FIGS. 1-4, except that the docking tube 92 now includes a sidewall 94 with an open cross-section. In particular, the docking tube 92 is tube-shaped except for a lengthwise gap 96 that extends along the entirety of the length of the docking tube 92 from a first end portion 98 of the docking tube 92 to a second end portion (not shown) of the docking tube 92. The docking tube 92 is formed from an elastically deformable material (for example, TPU), such that the sidewall 94 flexes radially outwardly to fit over a tapered golf club shaft 20 having an inner diameter that is greater than the inner diameter of the docking tube 92. Because the docking tube 92 is elastically deformable, the sidewall 94 flexes radially inwardly after the widest portion of the tapered golf club shaft 20 passes through the docking tube 92, such that the inner surface of the sidewall 94 maintains contact with the outer surface of the tapered golf club shaft 20. Consequently, the lengthwise gap 96 narrows from the uppermost portion of the docking tube 92 to the lowermost portion of the docking tube 92 when the golf club shaft 20 is positioned within the golf club grip 90. While described in relation to a tapered golf club shaft, the docking tube 92 can also be used with nontapered golf club shafts, provided the inner diameter of the docking tube 92 is slightly greater than the outer diameter of the golf club shaft 20.

As also shown in FIGS. 9A-9C, the docking tube 92 defines a section of a cylinder in the illustrated embodiment but can assume other shapes in other embodiments. The outer surface of the docking tube 92 and the inner surface of the elongated handle 100 define inter-engaging surfaces 102 and 104 that prevent relative rotation therebetween. For example, the inner surface of the docking tube 92 includes a planar portion 102 that engages first and second edges 104 of the sidewall 94, such that the docking tube 92 is prevented from rotating within the elongated handle 100. In other embodiments, the docking tube 92 includes one or more ribs as described above in connection with FIGS. 1-4 to prevent relative rotation between the docking tube 92 and the underlisting of the elongated handle 100. Further optionally, the inner surface of the docking tube 92 can be coated with a friction surface (for example, TPR) to resist rotation of the tapered golf club shaft 20 therein.

The golf club grip 90 of FIGS. 9A-9C also includes a lower clamp assembly 110 to removably secure the docking tube 92 to the golf club shaft 20. The lower clamp assembly 110 includes a ring clamp 112 that fits over the portion of the docking tube 92 that extends beyond the axial opening of the handle 100. The ring clamp 112 includes an inner surface 114 that is shaped to correspond to the outer surface of the docking tube 92 and to prevent relative rotation therebetween. The ring clamp 112 also includes a reduced inner diameter portion 120 in the gap between first and second edges 104 of the docking tube 92. The reduced inner diameter portion 120 bears against the golf club shaft 20 and prevents the golf club shaft 20 from bulging in response to the compression forces of the ring clamp 112. Consequently, the golf club shaft 20 is engaged about its entire circumference. A threaded opening 116 receives a screw or bolt 118 for locking the ring clamp onto the docking tube 92 and golf club shaft 20. While shown as a unitary element, the ring clamp 112 can alternatively comprise a split ring clamp having two ring sections. Removal of the ring clamp 112 is quickly achieved by removing the threaded fastener 118 and sliding the ring clamp 112 down the golf club shaft 20. If desired, the golf club grip 90 may then be removed from the golf club shaft 20 and replaced with a further golf club grip. In the illustrated embodiment, the golf club grip 90 does not include an upper clamp assembly. In other embodiments, the golf club grip 90 includes the upper clamp assembly 16 of FIGS. 5-6. In still other embodiments, the golf club grip 90 includes a cone-shaped plug (or other centering means) that is inserted into an opening in the guide cap 42, the cone-shaped plug centering the golf club shaft 20 within the elongated handle 100.

Referring now to FIGS. 10-21, a golf club grip in accordance with a third embodiment is illustrated and generally designated as golf club grip 130. The golf club grip 130 of FIGS. 10-21 is similar in structure and in function to the golf club grip 90 of FIG. 9A, except that the lower clamp assembly includes a compression clamp 140 and an installation tool 160. The compression clamp 140 provides a nonadjustable clamping force and is readily installed or removed with the installation tool 160. Each such feature of the golf club grip 130 is further described below.

Figure 12:
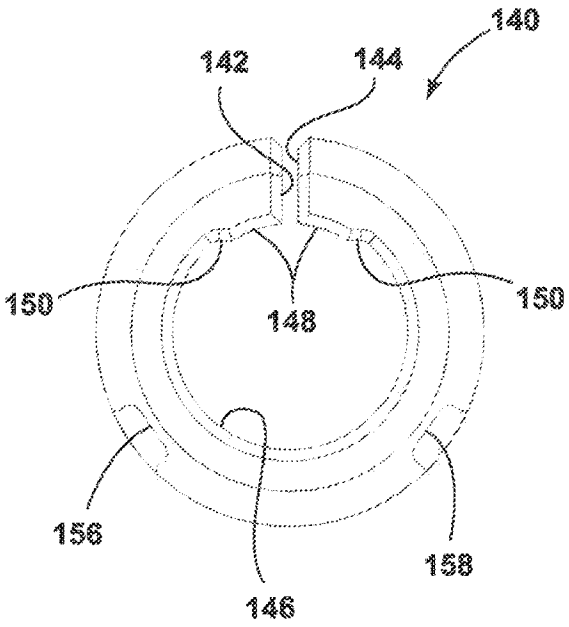
FIG. 12 is a front elevational view of the compression clamp of FIG. 10.

As shown in FIGS. 10-13, the compression clamp 140 fits over the portion of the docking tube 92 that extends beyond the axial opening of the handle 100. The compression clamp 140 is C-shaped and includes a first surface 142 opposite a second surface 144 to define a gap therebetween, such that the compression clamp 140 is expandable by varying the distance between the first surface 142 and the second surface 144. The inner circumference of the compression clamp 140 defines two curved surfaces: a first curved surface 146 about a major portion of its inner circumference, and a second curved surface 148 about a minor portion of its inner circumference. The first curved surface 146 abuts the outer surface of the docking tube 92, and the second curved surface 148 abuts the outer surface of the golf club shaft 20. The inner circumference of the compression clamp 140 also includes left and right planar segments 150 that interconnect the first curved surface 146 to the second curved surface 148. The planar segments 150 bear against the first and second edges 104 of the docking tube 92, preventing relative rotation between the docking tube 92 and the compression clamp 140. The second curved surface 148, being of a smaller inner diameter than the first curved surface 146, prevents the golf club shaft 20 from bulging into the gap between the first surface 142 and the second surface 144, which face each other as shown in FIG. 12. In other words, the golf club shaft 20 is engaged about its entire outer circumference, such that no portion of the golf club shaft 20 can bulge into the gap between the first surface 142 and the second surface 144 (or elsewhere). The first and second surfaces 142, 144 also define a cylindrical recess 152 for a screw or other implement, discussed below. As also shown in FIG. 12, the compression clamp 140 includes an outer curved surface 154 defining first and second slots 156, 158, generally positioned in the four-o'clock position and the eight-o'clock position, respectively. The first and second slots 156, 158 extend in the axial direction through a substantial portion of the depth of the compression clamp 140 for attachment to the removable installation tool 160. In addition, the compression clamp 140 can be selected to have a specific weight to improve performance during play. For example, the compression clamp 140 can be formed from tungsten, steel, aluminum, or other alloys for forward weighting of the golf club.

Figure 15:
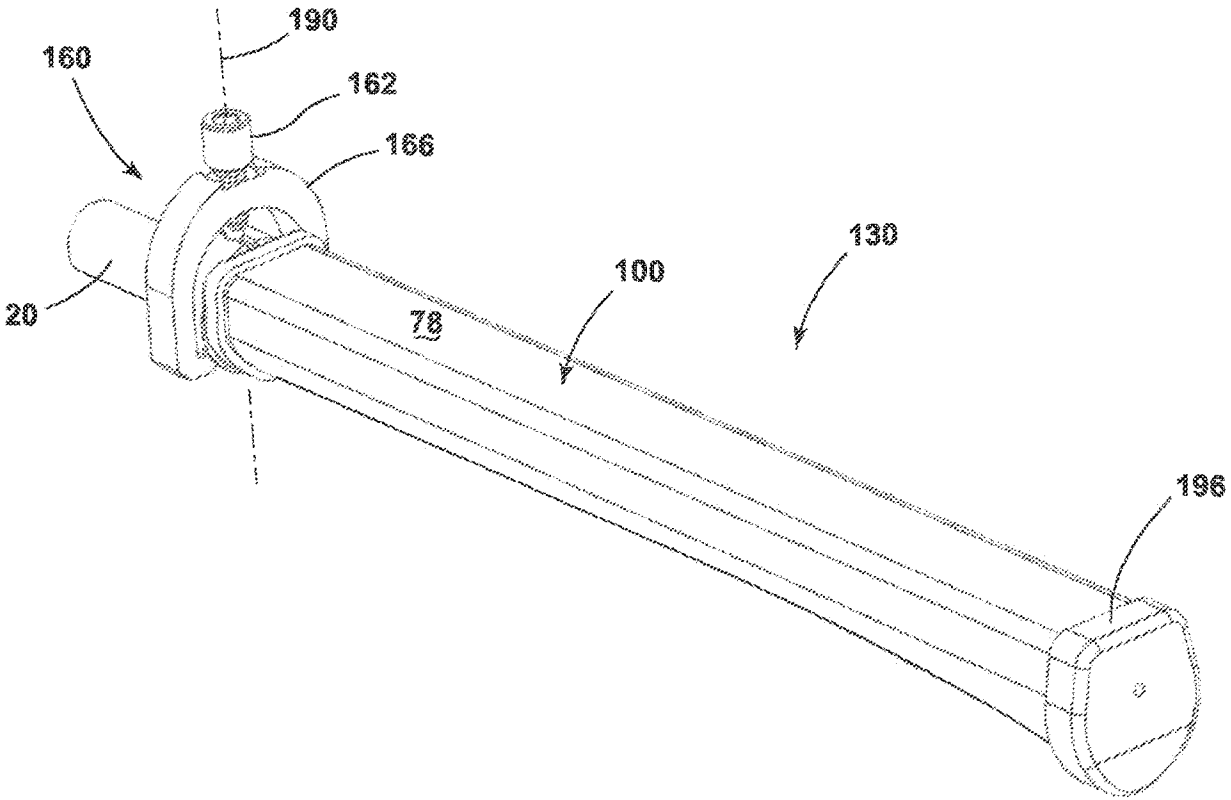
FIG. 15 is a second perspective view of the golf club grip of FIG. 10 including a removable installation tool.
Figure 16:
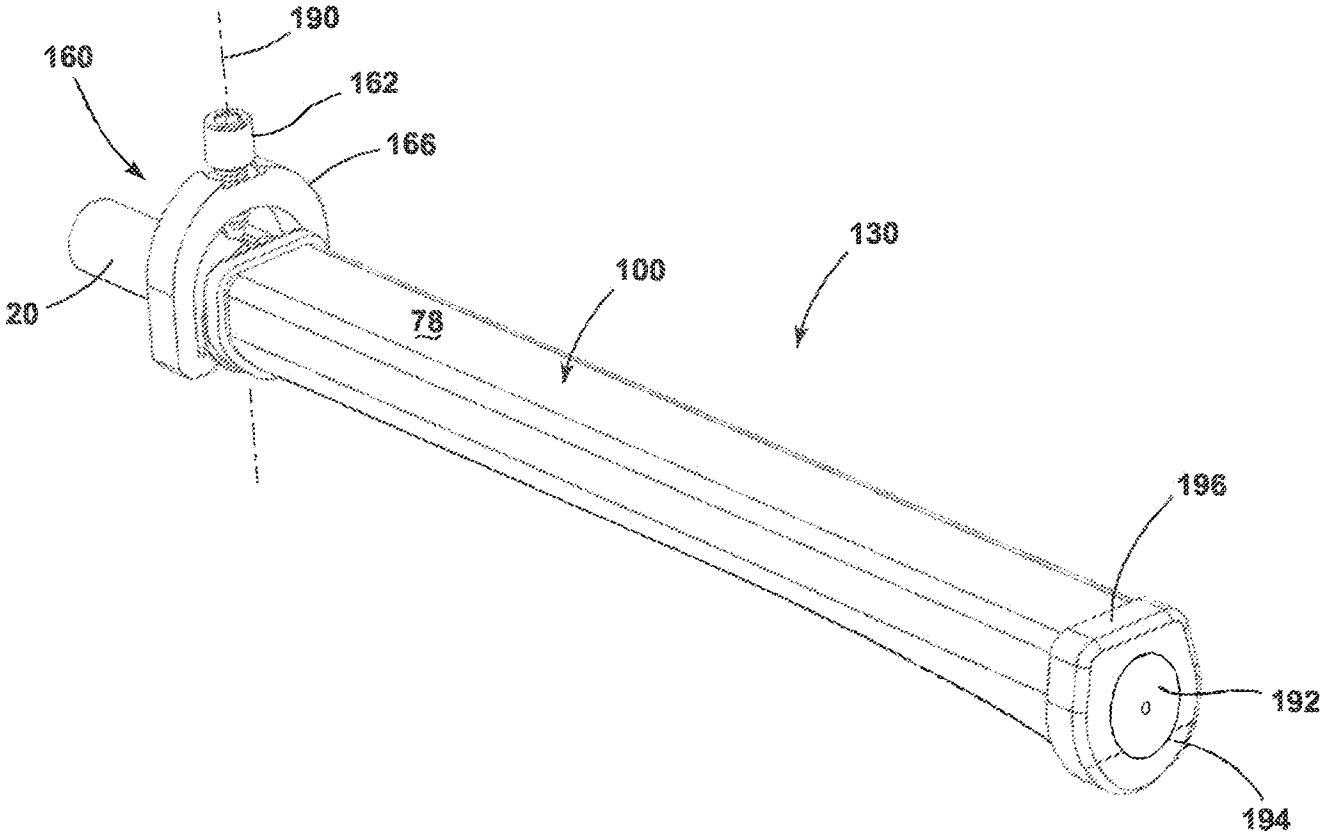
FIG. 16 is another perspective view of the golf club grip of FIG. 10 including a removable installation tool and a centering plug.
Figure 18:
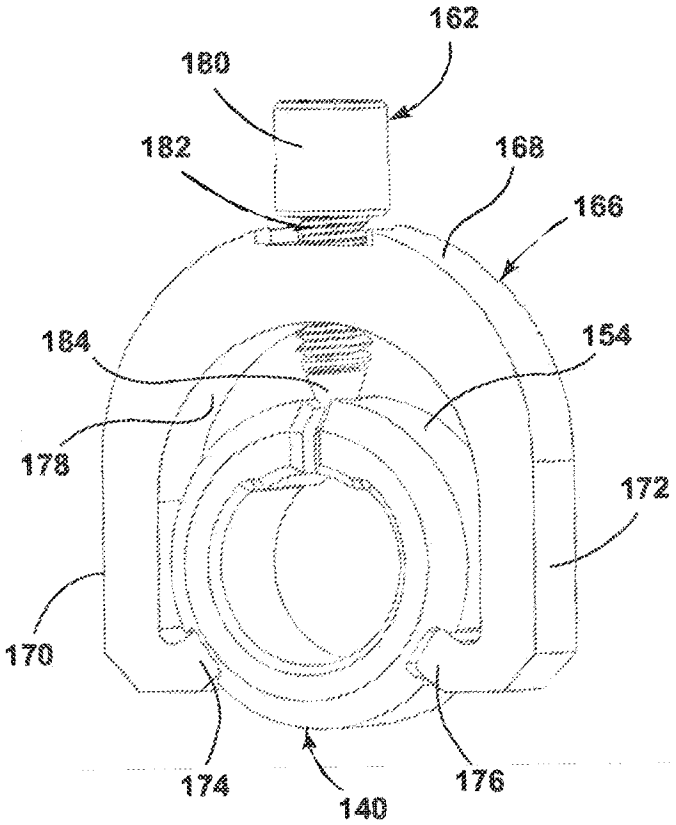
FIG. 18 is a perspective view of the removable installation tool during expansion of the compression clamp of FIG. 16.
Figure 17:
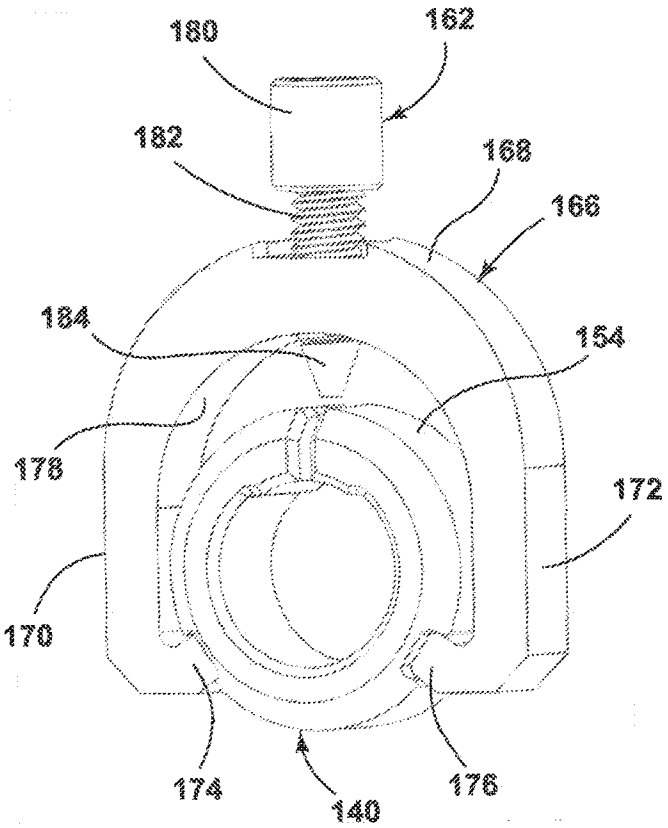
FIG. 17 is a perspective view of the removable installation tool of FIG. 16 prior to expansion of the compression clamp.
Figure 19:
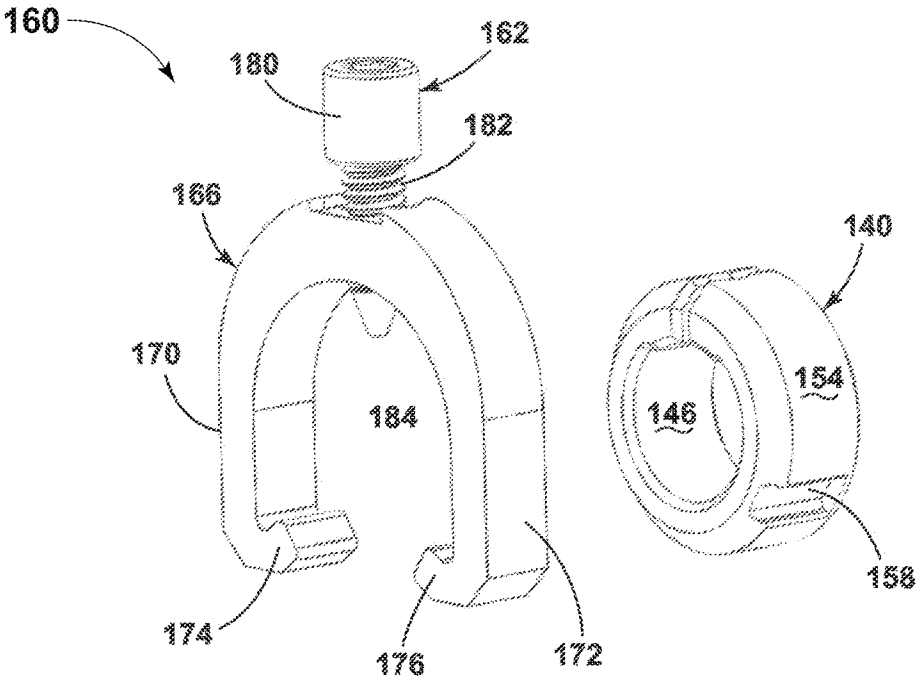
FIG. 19 is a partially exploded view of the removable installation tool and the compression clamp of FIG. 16.

Referring now to FIGS. 14-19, the removable installation tool 160 includes a screw 162 extending through a threaded opening 164 in an inverted U-shaped yoke 166. The yoke 166 includes a base portion 168 and left and right leg portions 170, 172. The left and right leg portions 170, 172 include inwardly angled end portions 174, 176 that are received within the first and second slots 156, 158 in the compression clamp 140. The threaded opening 164 extends entirely through the base portion 168, which is curved in the present embodiment but can be flat in other embodiments. As shown in FIG. 17, the yoke 166 includes an inner circumferential surface 178 that is spaced apart from the outer curved surface 154 of the compression clamp 140. The screw 162 (or other externally threaded element) includes an enlarged head 180, a threaded shank 182, and a conical tip 184. The enlarged head 180 limits downward travel of the screw 162, thereby preventing the conical tip 184 from contacting the golf club shaft 20. In particular, the enlarged head 180 (optionally having an opening for a hex tool or other implement) includes an outer diameter that is greater than the outer diameter of the threaded shank 182 and greater than the inner diameter of the threaded opening 164. The length of the threaded shank 182 is selected such that the conical tip 184 does not contact the golf club shaft 20 when the base of the head 180 abuts the upper surface of the yoke 166 adjacent the threaded opening 164.

Figure 14:
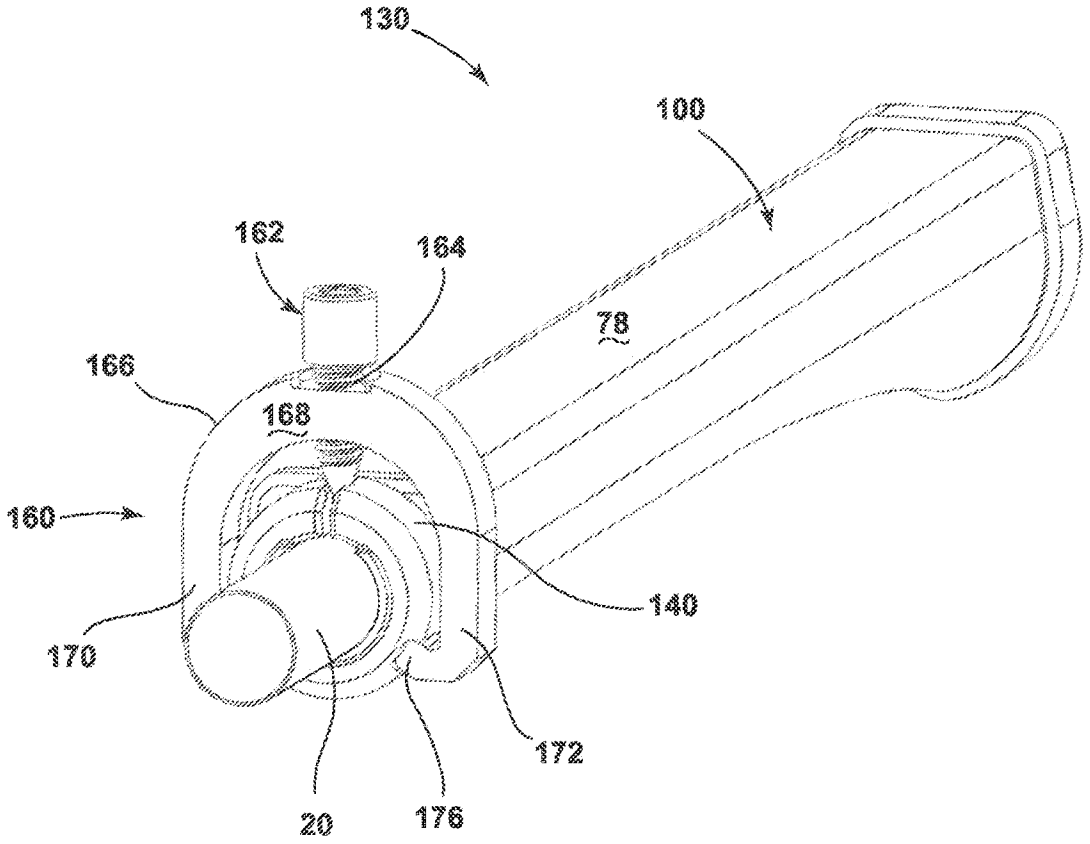
FIG. 14 is a first perspective view of the golf club grip of FIG. 10 including a removable installation tool.

As shown in FIGS. 14-16, the installation tool 160 is oriented such that the screw 162 is adjacent the forward-facing surface 78 (in the heel-to-toe direction) of the elongated handle 100. The screw 162 defines a longitudinal axis 190 that is orthogonal to the axis of the golf club shaft 20 and perpendicular to the forward-facing surface 78, with the outer gripping surface 76 not illustrated in this embodiment. The upper end of the elongated handle 100 does not include an upper clamp assembly in FIG. 15 but is modified in FIG. 16 to include a centering plug 192. The centering plug 192 is cone-shaped and is inserted into an opening 194 in the upper-end portion of the golf club shaft 20, thereby expanding the golf club shaft 20 outwardly against the docking tube 92 and centering the golf club shaft 20. Other embodiments can include other centering means, including the upper clamp assembly of FIG. 5, for example.

Figure 10:
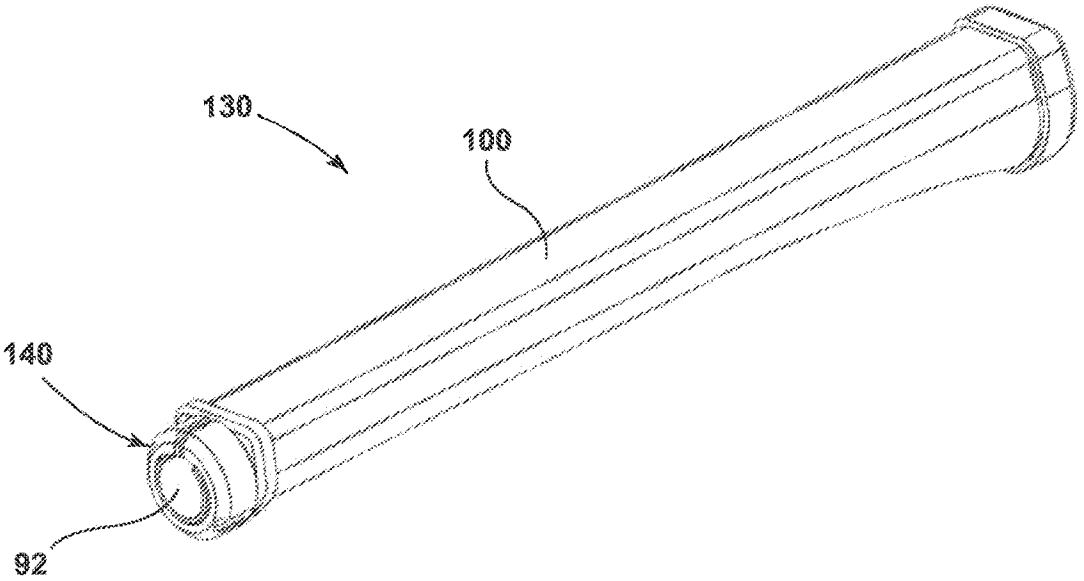
FIG. 10 is a perspective view of the golf club grip of FIG. 9A including a compression clamp in accordance with a third embodiment of the present invention.
Figure 11:
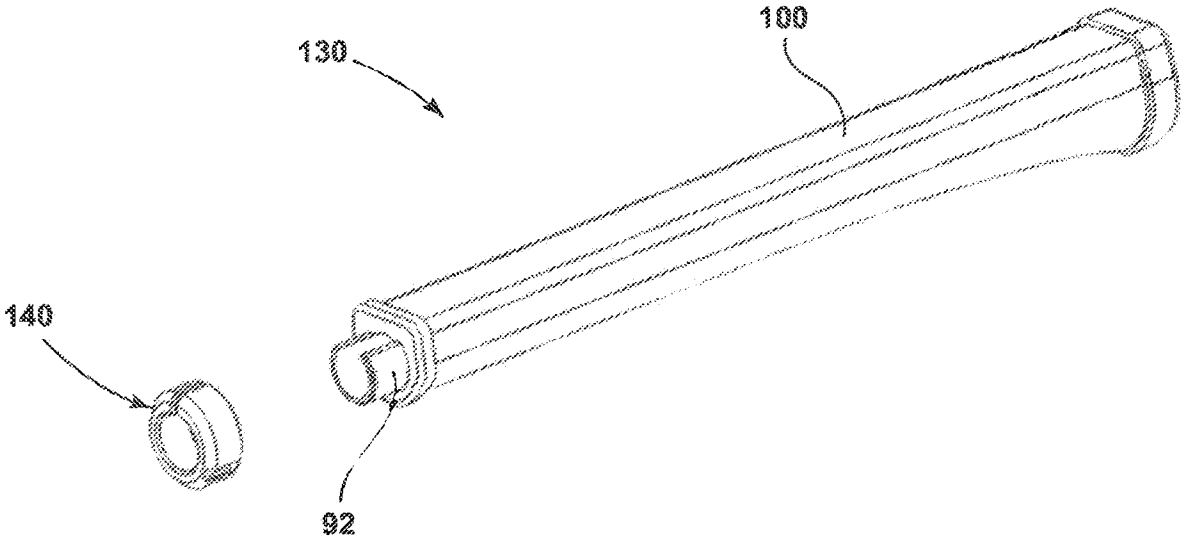
FIG. 11 is a partially exploded view of the golf club grip of FIG. 10.
Figure 13:
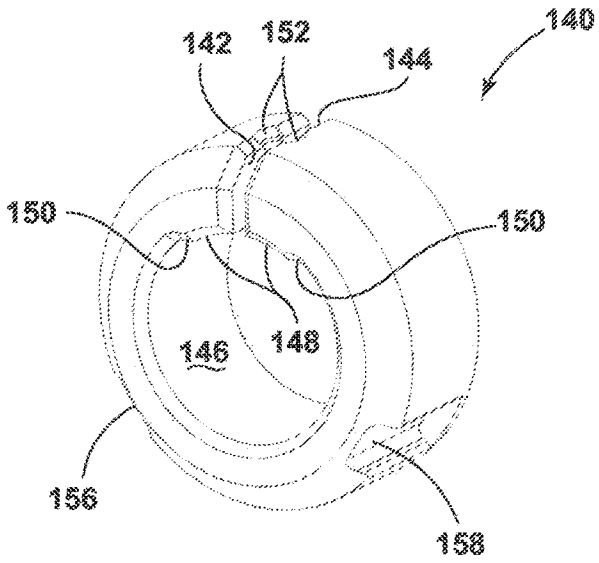
FIG. 13 is a perspective view of the compression clamp of FIG. 10.
Figure 20:
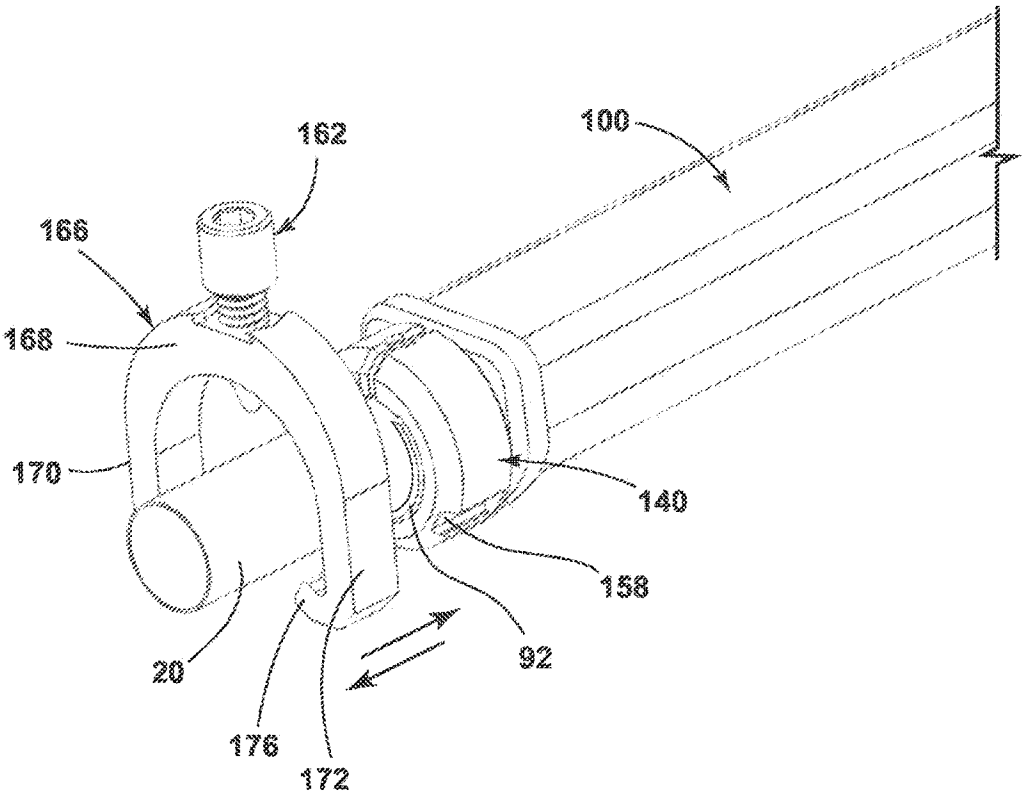
FIG. 20 is a first perspective view of the installation tool being of FIG. 16 removed from the golf club shaft.
Figure 21:
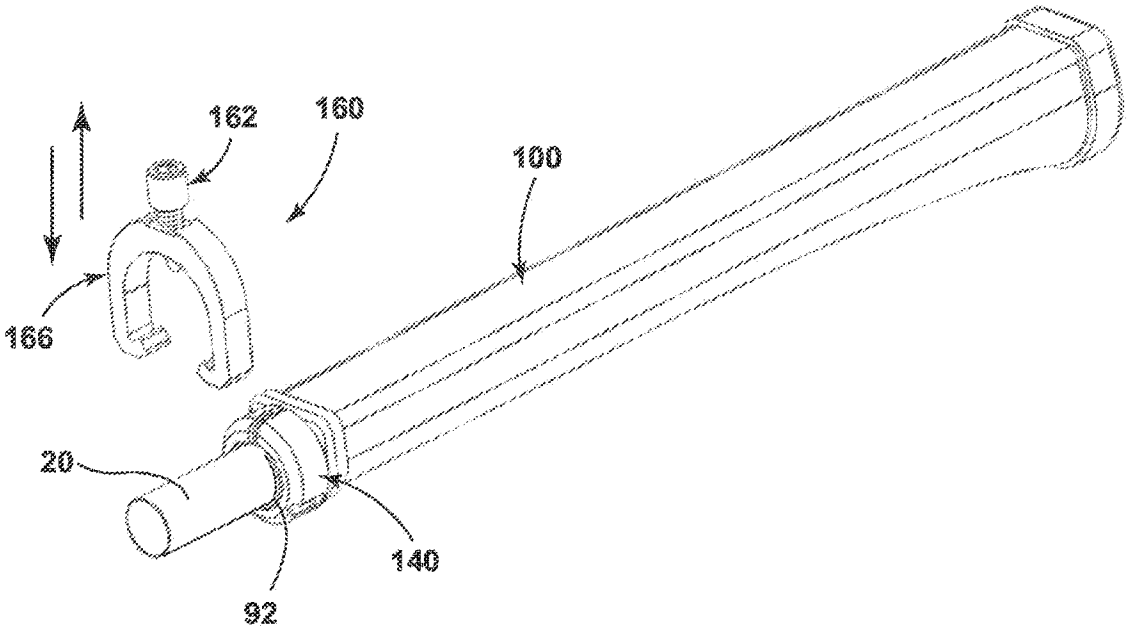
FIG. 21 is a second perspective view of the installation tool of FIG. 16 being removed from the golf club shaft.
Figure 22:
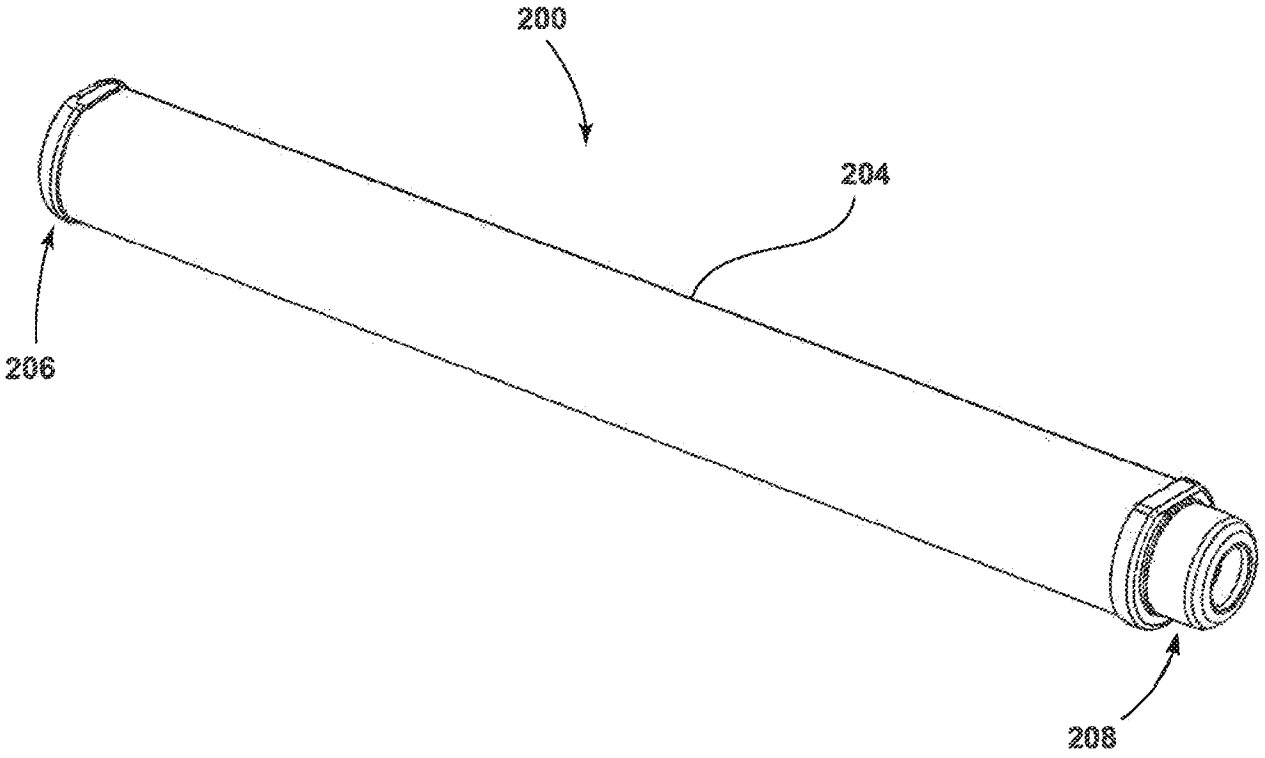
FIG. 22 is a perspective view of an interchangeable golf club grip in accordance with a fourth embodiment of the present invention.

The installation tool 160 can be used to install the golf club grip 130 of FIG. 10 onto a golf club shaft 20 in the following manner. The compression clamp 140 is positioned over the golf club shaft 20 before the golf club shaft 20 is inserted into the docking tube 92, which is contained within the elongated handle 100. In its unexpanded state, the compression clamp 140 includes an inner diameter that is less than the outer diameter of the docking tube 92. The installation tool 160 is then lowered onto the golf club shaft 20 (as shown in FIG. 21) and moved up the golf club shaft 20 (as shown in FIG. 20) until the inwardly angled end portions 174, 176 of the yoke 166 engage the first and second slots 156, 158 in the compression clamp 140. Rotation of the screw 162 causes its conical tip 184 to enter the gap between opposing surfaces 142, 144 of the compression clamp 140, thereby expanding the compression clamp 140. The user can then slide the compression clamp 140 over the docking tube 92 and back out the screw 162, thereby causing the compression clamp 140 to tighten over the docking tube 92. The user can then slide the installation tool 160 down the golf club shaft 20, away from the compression clamp 140 as shown in FIG. 20, and upwardly, away from the golf club shaft 20 as shown in FIG. 21.

Removal of the golf club grip 130 is accomplished in the same manner. First, the installation tool 160 is lowered onto the golf club shaft 20 as shown in FIG. 21 and moved up the golf club shaft 20 as shown in FIG. 20 until the inwardly angled end portions 174, 176 of the yoke 166 engage the first and second slots 156, 158 in the compression clamp 140. Rotation of the screw 162 in the clockwise (tightening) direction causes its conical tip 184 to enter the gap between opposing surfaces 142, 144 of the compression clamp 140, thereby expanding the compression clamp 140. The user can then retract the compression clamp 140 from the docking tube 92. Rotation of the screw 162 in the counter-clockwise (loosening) direction causes its conical tip 184 to withdraw from the gap between opposing surfaces 142, 144 of the compression clamp 140. Once the inwardly angled end portions 174, 176 of the yoke 166 are removed from the compression clamp 140, the installation tool 160 is freely removed from the compression clamp 140 and the golf club in general. The handle 100 is then able to be withdrawn from the golf club shaft 20, optionally for replacement with a further golf club handle but using the same compression clamp 140. The foregoing steps may be completed without the use of hand tools in some embodiments, for example by turning the screw 118 by hand. In other embodiments, including the illustrated embodiment, the foregoing steps are performed with only a hex key or other suitable implement.

Referring now to FIGS. 22-32, an interchangeable golf club grip in accordance with a fourth embodiment is illustrated and generally designated golf club grip 200. The interchangeable golf club grip 200 includes one or more of a universal docking tube 202, an elongated outer handle 204, an end cap assembly 206, and a collar assembly 208. As discussed below, in some embodiments the universal docking tube 202 is press-fit over a golf club shaft. In other embodiments, the universal docking tube 202 and the golf club shaft are a unitary construct. For example, the universal docking tube 202 and golf club shaft may be cast in a mold. In still other embodiments, universal docking tube 202 couples to an end of a golf club shaft, thereby increasing the length of the shaft. In some embodiments, for example, at least a portion of docking tube 202 is sized and configured to extend beyond the end of the golf club shaft after universal docking tube 202 is fully coupled to the golf club shaft.

The universal docking tube 202 remains affixed to the golf club shaft and can be used with a wide variety of handles 204, including handles for a round grip, a pistol grip, or a rectangular grip. The end cap assembly 206 centers the upper end of the docking tube 202 within the elongated handle 204, and the collar assembly 208 secures the lower end of the docking tube 202 to a golf club shaft. Each such feature is discussed below.

In some embodiments, the docking tube 202 defines a closed hollow structure. In other embodiments, the docking tube 202 defines an open structure (e.g., having a C-shaped cross-section). A docking tube 202 having a cross-sectional shape as shown in FIGS. 25-26 may undergo less thermal expansion or contraction than a docking tube having another geometric shape (e.g., circular, triangular, rectangular, pentagonal, hexagonal).

Figure 24:
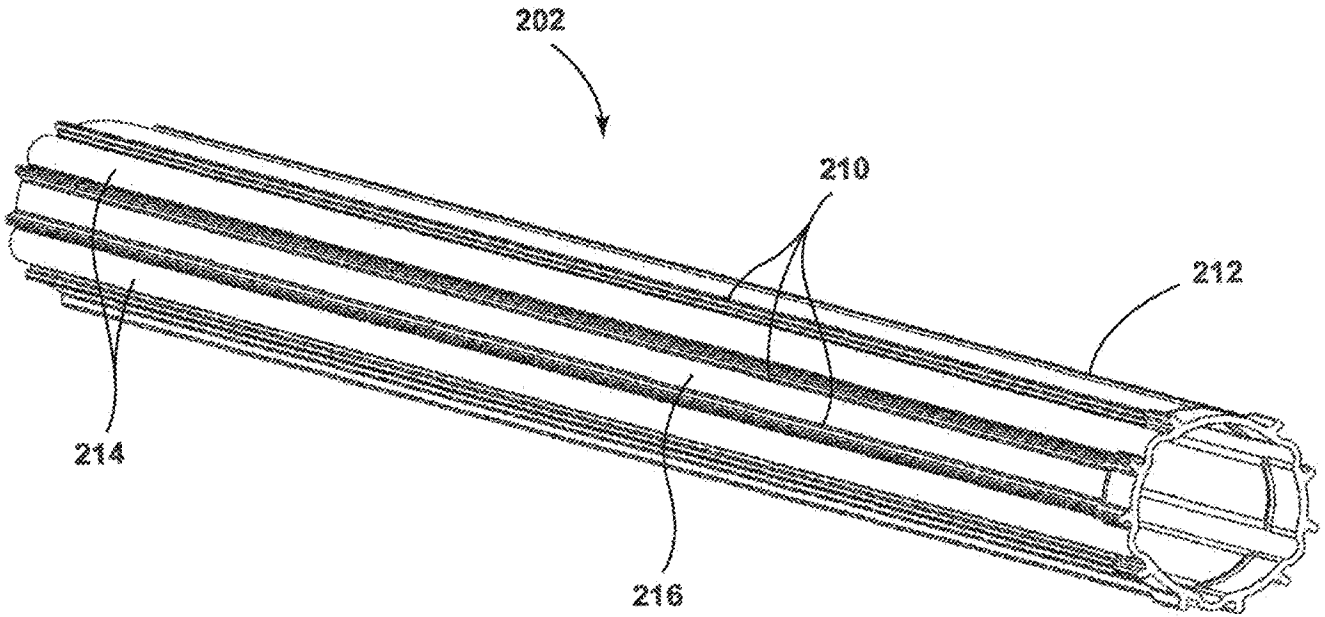
FIG. 24 is a perspective view of a docking tube that may be used in conjunction with the interchangeable golf club grip of FIG. 22.
Figure 25:
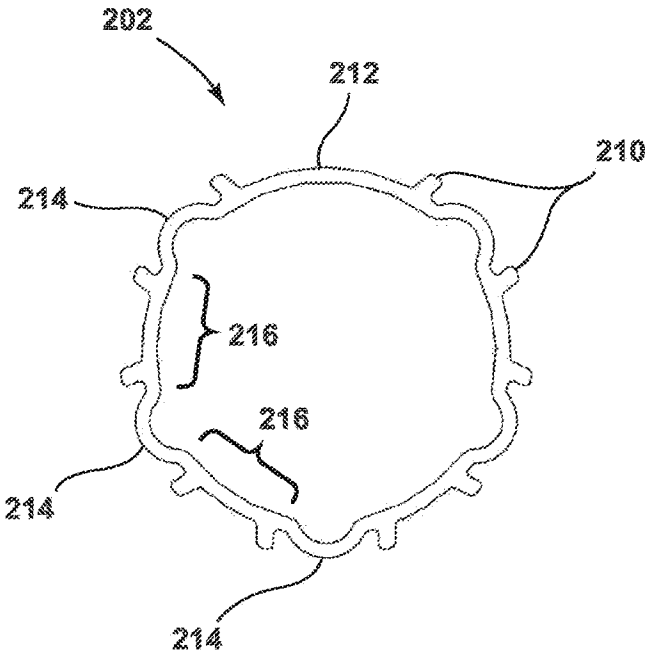
FIG. 25 is a cross-sectional view of the docking tube of FIG. 24.
Figure 26:
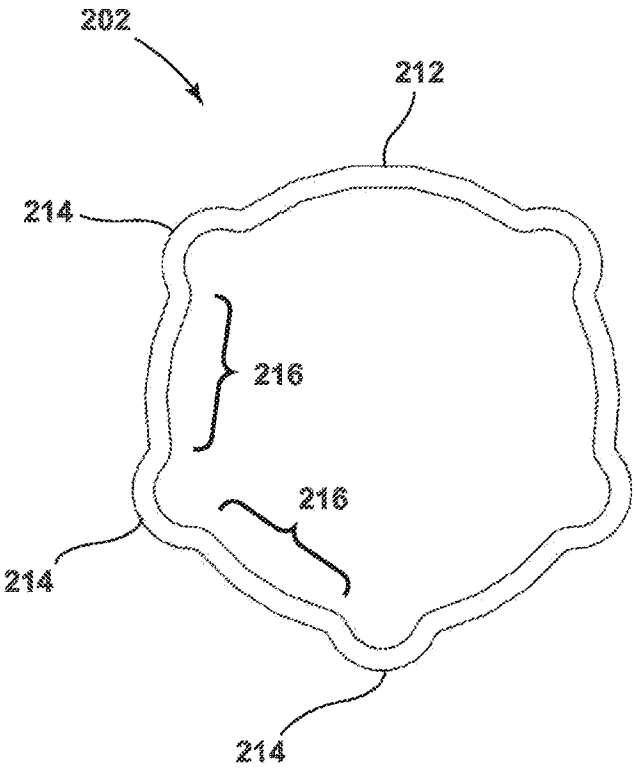
FIG. 26 is a cross-sectional view of the docking tube of FIG. 24 with the longitudinal ribs omitted.

The docking tube 202 is shown in FIGS. 24-25 and includes a plurality of longitudinal ribs 210 protruding radially outwardly from a cylindrical sidewall 212. In the embodiment shown in FIGS. 24-25, the ribs are oriented in pairs, such that alternating pairs of two ribs each extend parallel to each other along a substantial portion of the length of the docking tube 202, optionally the entire length of the docking tube 202 as shown in FIG. 24. Five rib pairings are shown in the current embodiment, corresponding to five channels in the underlisting or elongated handle; however, the docking tube can include a different number of rib pairings in other embodiments.

In some embodiments, the ribs are optional. Some embodiments, including the embodiment shown in FIG. 28, the ribs are omitted. The docking tube 202 may include two longitudinal ribs, three longitudinal ribs, four longitudinal ribs, five longitudinal ribs, six longitudinal ribs, seven longitudinal ribs, eight longitudinal ribs, two to four longitudinal ribs, four to six longitudinal ribs, or six to eight longitudinal ribs.

In some embodiments, the longitudinal ribs 210 extend the entire length or substantially the entire length of the docking tube 202. In other embodiments, the longitudinal ribs 210 extend along a portion of the length of the docking tube 202. In some embodiments, the longitudinal rib 210 is uninterrupted along its length. In other embodiments, the longitudinal rib 210 includes two or more segments spaced from each other along its length.

In some embodiments, the longitudinal ribs 210 extend along an axis generally parallel to a longitudinal axis of the docking tube 202. For example, the longitudinal ribs 210 may be coplanar with the longitudinal axis of the docking tube 202. In other embodiments, the longitudinal ribs 210 may be at an angle relative to the longitudinal axis of the docking tube 202 such that the elongated handle must be rotated when coupling the elongated handle to the docking tube 202. In some embodiments, the longitudinal ribs 210 define a thread that engages a thread on the underlisting or elongated handle.

As also shown in FIGS. 24-25, the cylindrical sidewall 212 includes a lengthwise projection 214 between adjacent ribs 210. The lengthwise projection 214 is outwardly convex when viewed in cross-section, being a raised portion of the cylindrical sidewall 212 (e.g., extending radially outwardly further than an adjacent portion of the sidewall). The lengthwise projections 214 include a reduced radius of curvature, such that each lengthwise projection 214 forms part of an arc of a circle in cross-section with a height approximately equal to the height of the longitudinal ribs 210. In other embodiments, the lengthwise projection 214 may have a rectangular, triangular or other geometric shape.

Each lengthwise projection is connected to an adjacent lengthwise projection by an intermediate section 216 of the cylindrical sidewall 212. The intermediate section 216 define a radius of curvature that is greater than the radius of curvature defined by the lengthwise projections 214.

The lengthwise projection 214 may extend along a substantial portion of the length of the docking tube 202, optionally along the entire length of the docking tube 202 as shown in FIG. 26. In some embodiments, the lengthwise projection 214 may extend the entire length or substantially the entire length of the docking tube 202. In other embodiments, the lengthwise projection 214 extends along a portion of the length of the docking tube 202. In some embodiments, the lengthwise projection 214 is uninterrupted along its length. In other embodiments, the lengthwise projection 214 includes two or more segments spaced from each other along its length.

In some embodiments, the lengthwise projection 214 extends along an axis generally parallel to a longitudinal axis of the docking tube 202. For example, the lengthwise projection 214 may be coplanar with the longitudinal axis of the docking tube 202. In other embodiments, the lengthwise projection 214 may be at an angle relative to the longitudinal axis of the docking tube 202 such that the elongated handle must be rotated when coupling the elongated handle to the docking tube 202. In some embodiments, the lengthwise projection 214 defines a thread that engages a thread on the underlisting or elongated handle. The lengthwise projection 214 may be generally parallel to one or more longitudinal ribs 210.

Figure 27:
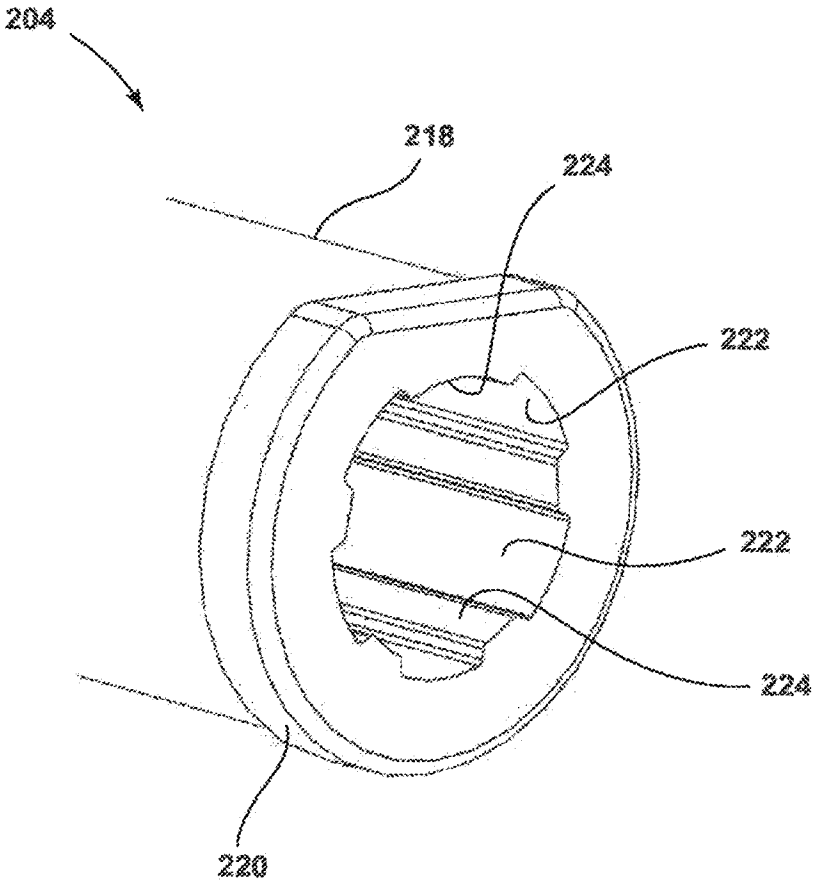
FIG. 27 is a perspective view of the axial opening of an elongated handle in accordance with one embodiment of the present invention.

The elongated handle 204 includes an outer grip surface 218 and an underlisting 220. As shown in FIG. 27, the underlisting 220 includes an interior opening defining a plurality of channels 222 that are recessed or set back from an annular surface 224. In some embodiments, the channels 222 are asymmetrically disposed about a central longitudinal axis 226, forming a keyed opening that accepts the docking tube 202 in only a single orientation. In other embodiments, the channels 222 are symmetric about the central longitudinal axis 226 such that the docking tube 202 can be accepted in a plurality of orientations.

Figure 28:
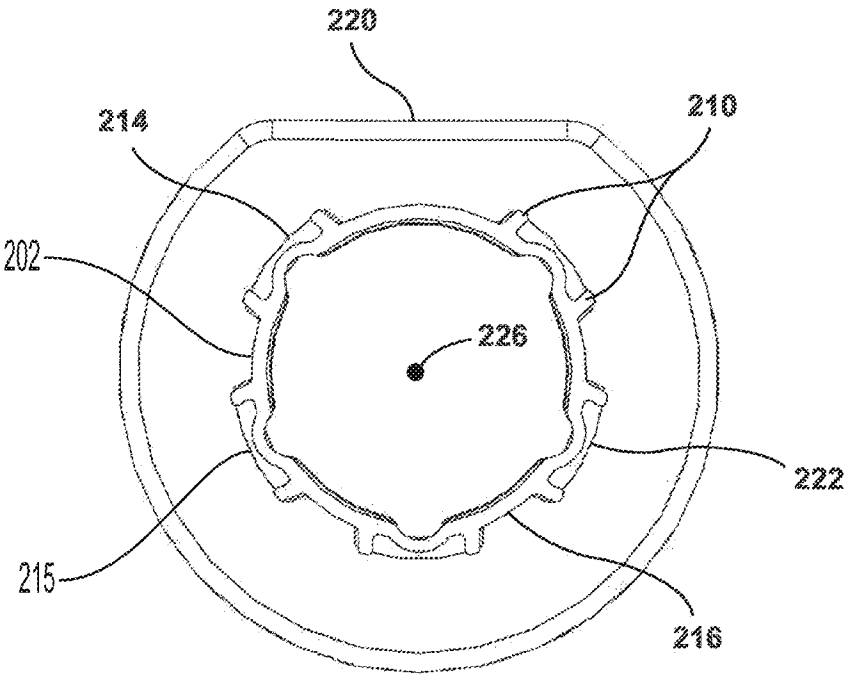
FIG. 28 is a first end view of the docking tube of FIG. 25 received within the axial opening in the elongated handle of FIG. 27.

Each channel 222 is shaped (e.g., rectangular or semicircular) in cross-section to accept one or more ribs 210 (e.g., two laterally spaced ribs which may be parallel) and/or a lengthwise projection 214, best shown in FIG. 28. The lengthwise projections 214 allow the docking tube inner diameter to expand outwardly and extend over the widest portion of the golf club shaft. Because the docking tube 202 is elastically deformable, the lengthwise projections 214 contract after passing over the top of the golf club shaft 270 and the intermediate portions 216 continue to engage the golf club shaft along the length of the golf club grip 200.

The lengthwise projections 214 of the docking tube 202 may have a sidewall thickness that is different from the sidewall thickness of the intermediate portion 216 such that the lengthwise projections 214 are resiliently flexible. The lengthwise projections 214 may be formed from a first material and another portion of the docking tube 202 may be formed from a second material that is different from the first material.

One or more of the docking tube 202, handle 204, and underlisting 220 may be manufactured from a material that is different than the material of the other of the docking tube 202, handle 204, and underlisting 220. The different materials may have different coefficients of thermal expansion. Referring to FIG. 28, a portion of the docking tube 202 may be radially spaced from the elongated handle 204 or underlisting 220. This space may allow for thermal expansion of the docking tube 202 or handle 204 while engaged with each other.

In some embodiments, the docking tube 202 is formed from a thermoplastic, for example polyvinyl chloride (PVC), while in other embodiments the docking tube 202 is formed from a metal or metal alloy (e.g., aluminum or aluminum alloys, titanium or titanium alloys, steel, etc.). In some embodiments, forming docking tube 202 from a metallic material may allow docking tube 202 to have a thinner sidewall than embodiments formed from thermoplastic. In still other embodiments, at least a portion of the docking tube 202 is formed from steel or rubber. In some embodiments, docking tube 202 is made of metal (e.g., aluminum or steel). In other embodiments, docking tube 202 is made of a composite material (e.g., graphite composite or fiber reinforced polymer). A metal docking tube 202 may have a wall thickness from about 0.005" to about 0.05", for example, about 0.005", about 0.01", about 0.015", about 0.03", or less than about 0.05". A composite docking tube 202 may have a wall thickness of about 0.02", about 0.035", about 0.05", or less than about 0.075". A metal docking tube may have a thinner sidewall than a composite docking tube. A metal docking tube may have a ratio of wall thickness to stiffness or rigidity compared to a composite docking tube. A metal docking tube may have tighter manufacturing tolerances than a composite docking tube. A metal docking tube may be corrosion resistant to water based solvents. The docking tube 202 may be manufactured by extrusion, die casting, or milling. In some embodiments, docking tube 202 may be produced by an additive manufacturing process (e.g., 3D printing). Docking tube 202 may include an anodized or plated surface. An anodized or plated surface may reduce or minimize frictional forces when assembling high friction materials like rubber or other elastomeric sleeves onto the docking tube.

Elongated handle 204 may be made of a lightweight and/or elastic material. In some embodiments, elongated handle is made of a polymeric material (e.g., ethylene-vinyl acetate ("EVA"), EVA coated with polyurethane, foam rubber, polypropylene foam, polyethylene foam, rubber, or oxygenated thermoplastic). Elongated handle may have a hardness of 80 Shore A or softer. A softer grip may provide a better feel for the user than a harder grip during use of the handle. A polymeric handle may be elongated to overcome interference fit features of the docking tube. Elongated handle may be made of a material with a closed cell design. A closed cell design may prevent water absorption. A closed cell design may provide resistance to oxygen, ozone, and light.

In some embodiments, docking tube 202 is made of metal and elongated handle is made of polymer. In other embodiments, docking tube 202 is made of polymer and elongated handle 204 is made of metal. In still other embodiments, docking tube 202 and handle 204 are each made of polymer or composite. In some embodiments, a ratio of the weight of the grip to the torsional resistance is about 0.1 to about 2.0, about 0.75 to about 1.5, about 0.5 to about 1.0, or less than about 1.0. In other embodiments, a ratio of the weight of the grip to the torsional resistance is about 10 to about 40, about 15 to about 30, or about 20 to about 25. In some embodiments, a ratio of the weight of the grip to the torsional resistance of a docking tube (e.g., a metal docking tube) and an underlisting (e.g., plastic, composite, or EVA) is about 0.5 to about 1.0 or less than about 1.0. In some embodiments, a ratio of the weight of the grip to the torsional resistance of a docking tube (e.g., a plastic docking tube) and an underlisting (e.g., plastic, composite, or EVA) is about 20 to about 24.

The rib 210 and lengthwise projection 214 may extend radially outwardly away from the sidewall of the docking tube 202. In some embodiments, the channel 222 may receive at least one of rib 210 and lengthwise projection 214. The rib 210 or lengthwise projection 214 may extend radially outwardly such that an end of the rib 210 or lengthwise projection 214 contacts an endwall 215 of the channel 222. The end of the rib 210 or lengthwise projection 214 may contact the endwall 215 of the channel 222 while the portion of the sidewall 212 between the rib 210 and lengthwise projection 214 may be radially spaced from the endwall 215 of the channel 222. The rib 210 may contact the endwall 215 of the channel 222 and the lengthwise projection 214 may be radially spaced from the endwall 215. The rib 210 may be compressed radially by the endwall 215. In some embodiments, the rib 210 is compressed by the sidewall of the channel 222. In other embodiments, the sidewall of the channel 222 is compressed by the rib 210.

In some embodiments, the docking tube 202 includes the lengthwise projections 214 and the ribs 210 and the elongated handle 204 includes the channel 222. In other embodiments, the elongated handle 204 includes the lengthwise projections 214 and the ribs 210 and the docking tube 202 includes the channel 222. In still other embodiments, the docking tube 202 and elongated handle 204 each include a combination of lengthwise projections 214, ribs 210 and channels 222. The channel 222, ribs 210, or projections 214 may extend the length of the handle 204 or docking tube 202 such that the handle 204 is rotationally fixed relative to the docking tube 202 and shaft as the handle is being coupled to the docking tube. For example, the handle 204 may be rotationally fixed relative to the docking tube 202 and shaft once at least about 1%, about 2%, about 3%, about 4%, about 1% to about 5%, about 5% to about 10%, or about 10% to about 20% of the length of the handle 204 overlaps the docking tube 202. In some embodiments, the handle 204 forms a prismatic joint with the docking tube 202 and can only move linearly with respect to docking tube 202 (e.g., along a lengthwise direction). Thus, in some embodiments, handle 204 has only a single degree of freedom with respect to docking tube 202.

Figure 23:
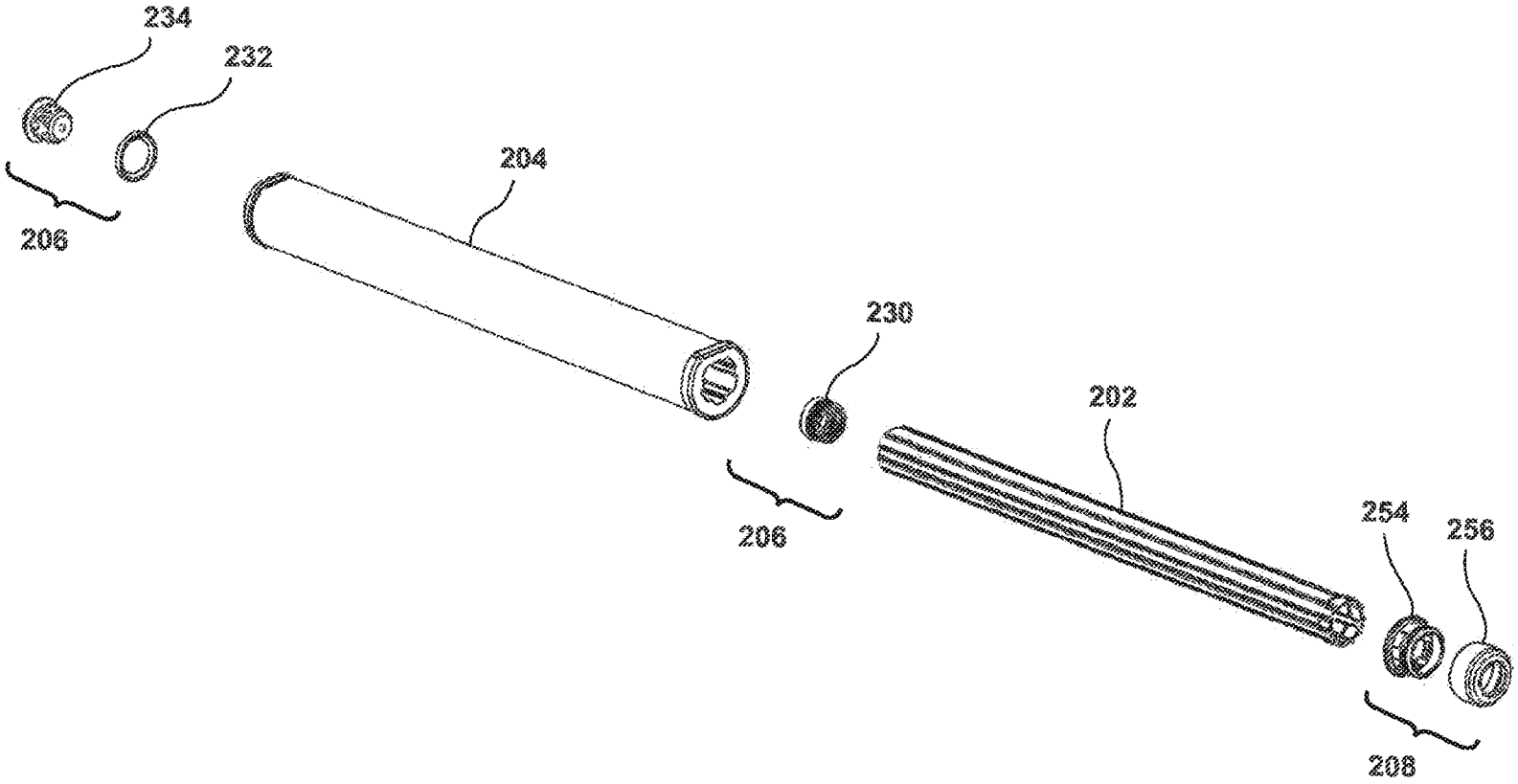
FIG. 23 is an exploded view of the interchangeable golf club grip of FIG. 22.
Figure 29:
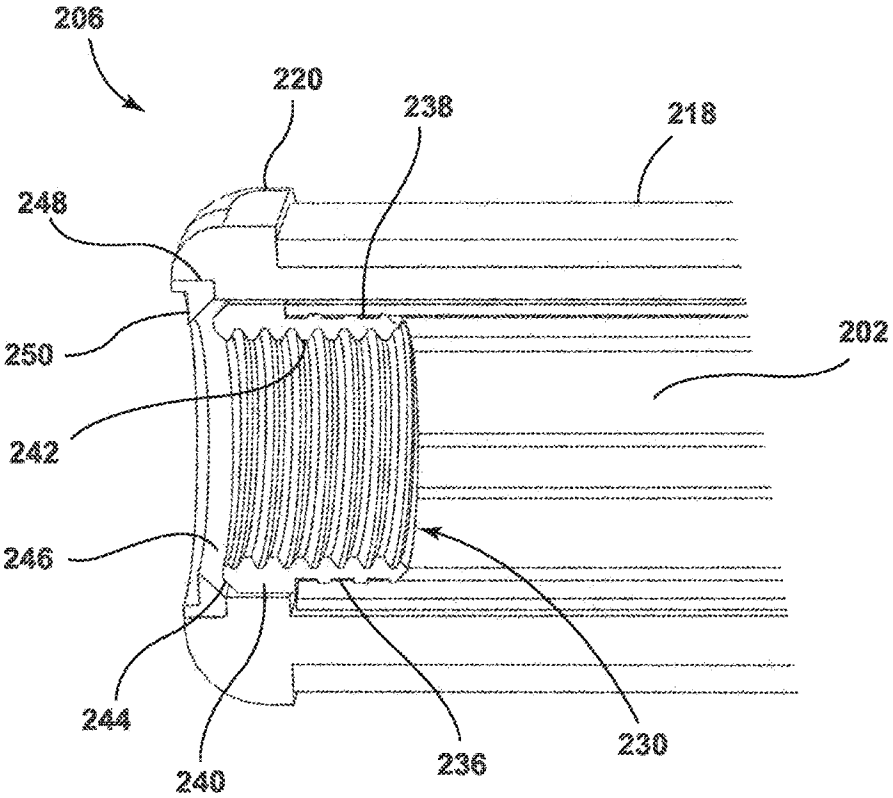
FIG. 29 is a side cross-sectional view of a portion of the elongated handle of FIG. 22.

The end cap assembly 206 is shown in FIG. 29 and includes a threaded insert 230. The end cap assembly 206 may receive a ring insert 232 and/or a weighted end cap 234 as shown in FIG. 23. The threaded insert 230 includes an externally threaded shank 236 that threadedly engages an internally threaded portion 238 of the docking tube 202. Adhesive may be implemented to permanently bond the threaded insert 230 to the docking tube 202. The threaded insert 230 also includes a head 240, which includes an outer diameter that is greater than or equal to the outer diameter of the externally threaded shank 236. An internally threaded bore 242 extends through the head 240 and the shank 236 of the threaded insert 230 for engagement by the weighted end cap 234. The threaded insert 230 may be sized and shaped to engage a tool (e.g., a screwdriver, wrench, or Allen wrench) to couple the threaded insert 230 to the docking tube 202.

The head 240 of the threaded insert 230 includes a chamfered annular surface 244 to engage the ring insert 232. The ring insert 232 also includes a corresponding chamfered annular surface 246 that engages the chamfered annular surface 244 of the threaded insert 230, thereby ensuring that the threaded insert 230, and consequently the docking tube 202, is centered within the elongated handle 204. The ring insert 232 is glued to a stepped opening 248 in the butt end of the underlisting 220 to provide a flat engagement surface 250 for the weighted end cap 234. The threaded insert 230 is optionally formed from aluminum, and the ring insert 232 is optionally a glass-filled polymer—for example, a glass-filled polyamide. The weighted end cap 234 is optionally the weighted end cap disclosed in U.S. Pat. No. 9,463,363, filed Mar. 3, 2015, the disclosure of which is hereby incorporated by reference in its entirety.

Figure 30:
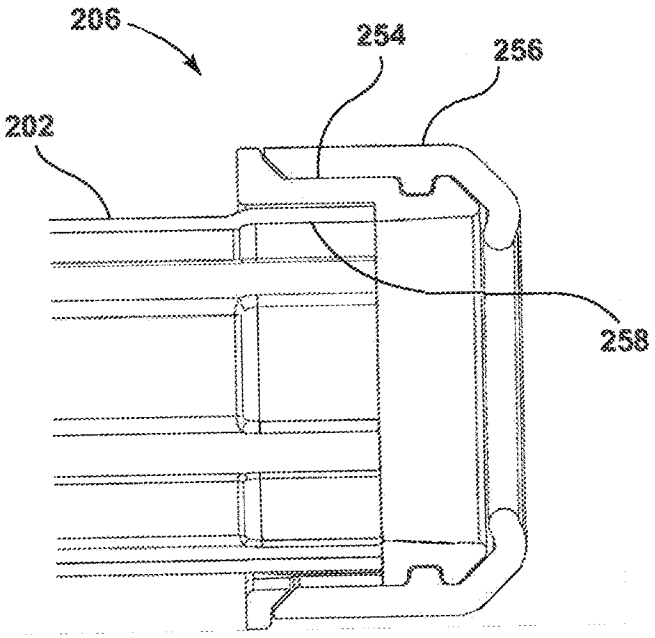
FIG. 30 is a side cross-sectional view of a portion of the elongated handle of the golf club grip of FIG. 22.

A distal end of the docking tube 202 may extend distally beyond a distal end of the elongated handle 204. The collar assembly 208 may be coupled to the distal end of one or more of the docking tube 202 and the elongated handle 204. One embodiment of the collar assembly 208 is shown in FIG. 30. The collar assembly 208 includes a docking collar 254 and a docking sleeve 256. The docking collar 254 can be formed from a glass-filled polymer—for example, a glass-filled polyamide—and extends over a flared end 258 of the docking tube 202. The docking collar 254 also assists in centering the docking tube 202 during installation by compressing the docking tube 202 against the golf club shaft. The docking sleeve 256 can be formed from EVA plastic or other materials and extends over the docking collar 254 to provide a clean appearance at the base of the golf club grip 200. The docking sleeve 256 optionally includes a plurality of slits for trafficking an adhesive during installation of the docking tube 202.

Figure 36:
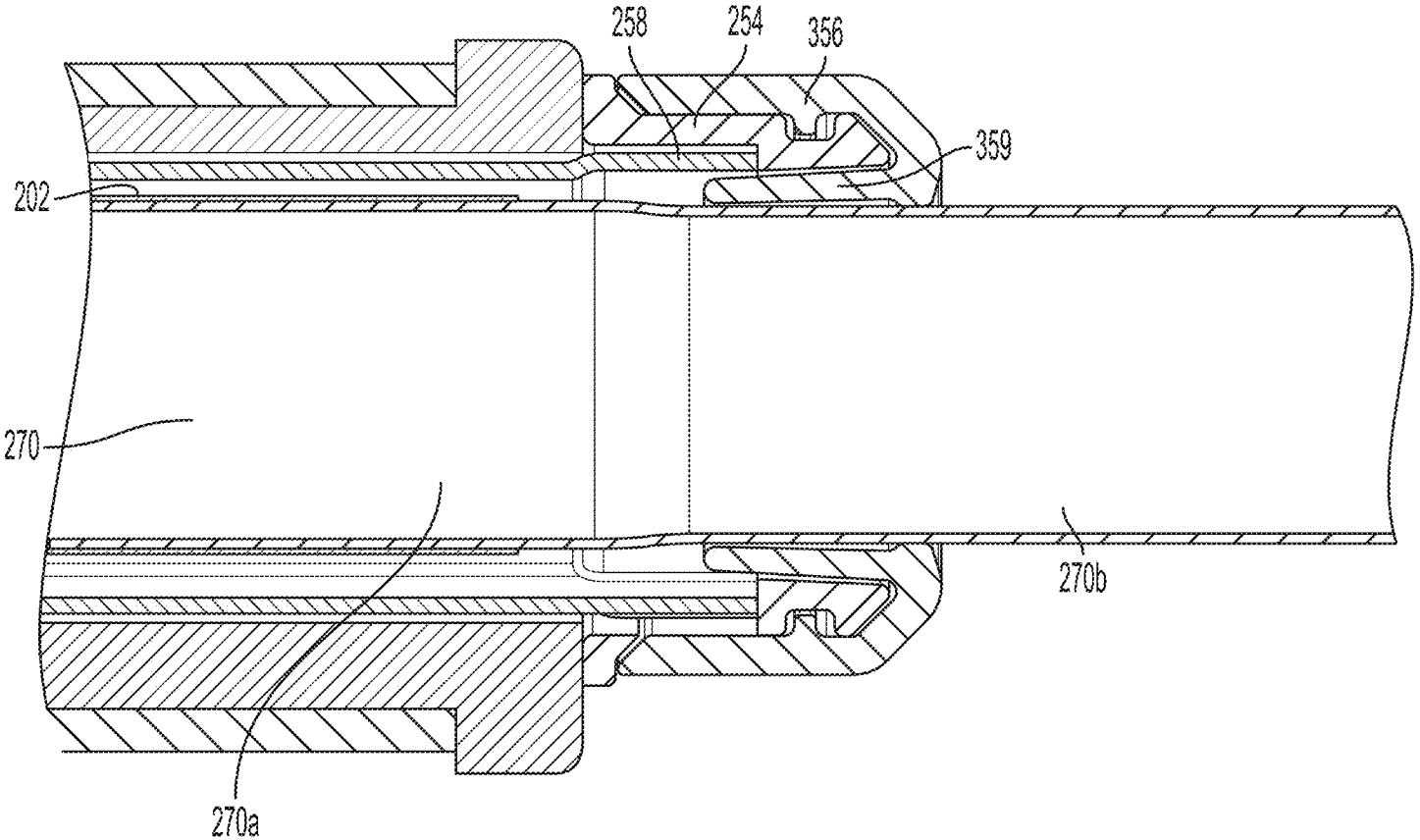
FIG. 36 is side cross-sectional view of a portion of the elongated handle of the golf club grip of FIG. 22 with a docking collar in accordance with another embodiment of the present invention.

FIG. 36 illustrates another embodiment of a docking sleeve 356. Docking sleeve 356 may be similar to docking sleeve 256 but docking sleeve 356 may include a shim 359. Shaft 270 may include a first portion 270*a* and a second portion 270*b*. First portion 270*a* may have a different (e.g., larger) diameter than second portion 270*b*. Docking sleeve 356, docking collar 254, and docking tube 202 may be sized to fit over the larger diameter portion (e.g., first portion 270*a*) of shaft 270. Shim 359 may be positionable between shaft 270 and one or both of a portion (e.g., flared end 258) of docking tube 202 and docking collar 254. Shim 359 may decrease the effective diameter of docking tube 202 and docking collar 254 such that the docking tube 202 and docking collar 254 may be positioned on the smaller diameter portion of shaft 270 while maintaining a tight fit on the shaft 270. Shim 359 and docking sleeve 356 may define a recess to receive one or more of docking collar 254 and docking tube 202. Shim 359 may be flexible relative to docking sleeve 356. Shim may extend circumferentially around the perimeter of shaft 270. In some embodiments, shim 359 and docking sleeve 356 are a unitary construct. In other embodiments, shim 359 is a separate element from docking sleeve 356 and is couplable to docking sleeve 356. There may be a frangible connection between shim 359 and docking sleeve 356 such that shim 359 may be selectively detached from docking sleeve 356. At least one of shim 359 and docking sleeve 356 may extend distally beyond a distal end of docking collar 254.

Figure 31:
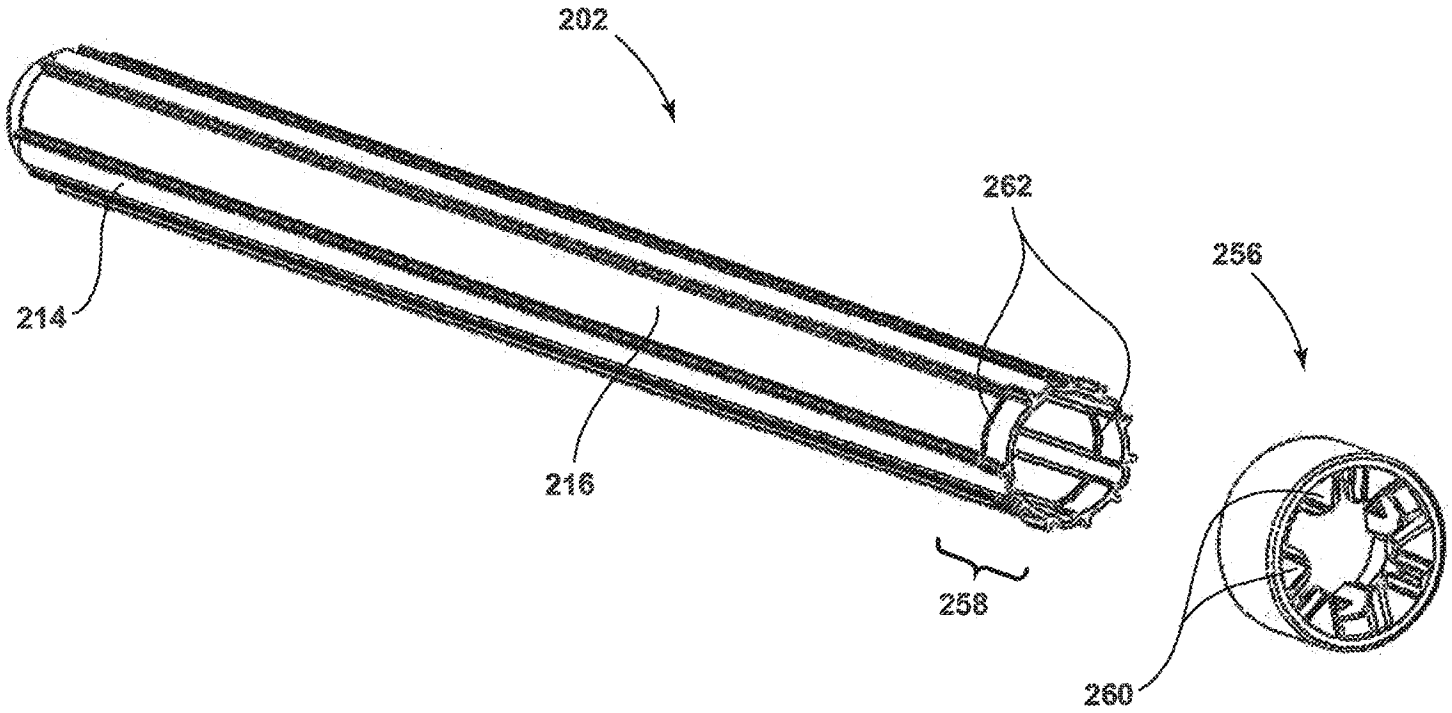
FIG. 31 is an exploded view of a docking tube and docking sleeve as a modification of the embodiment of FIG. 22.
Figure 32:
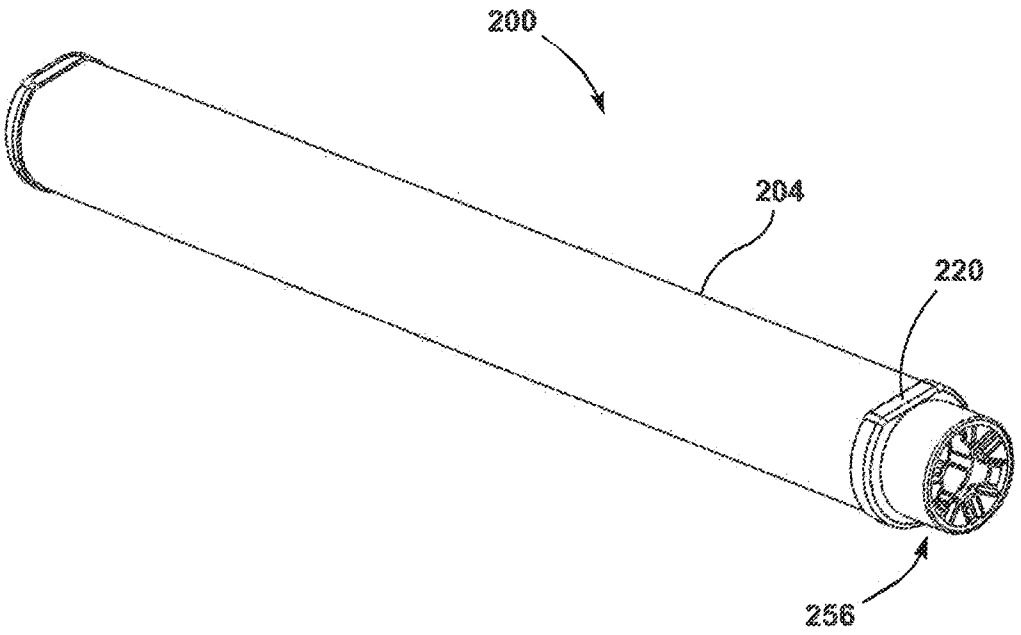
FIG. 32 is a perspective view of a docking tube and docking sleeve as a modification of the embodiment of FIG. 22.

The docking collar 254 may be optional, and, in some embodiments, the docking collar 254 is omitted and the docking sleeve 256 directly engages the lower end 258 of the docking tube 202. As shown in FIGS. 31-32, for example, the docking sleeve 256 directly engages the docking tube 202, having radial projections 260 that are received within corresponding recesses 262 in the docking tube 202. The radial projections 260 are spaced apart from each other to prevent an adhesive on a wetted tape from being completely removed by movement of the docking sleeve 256 over the wetted tape.

Figures 33A, 33B, 33C:
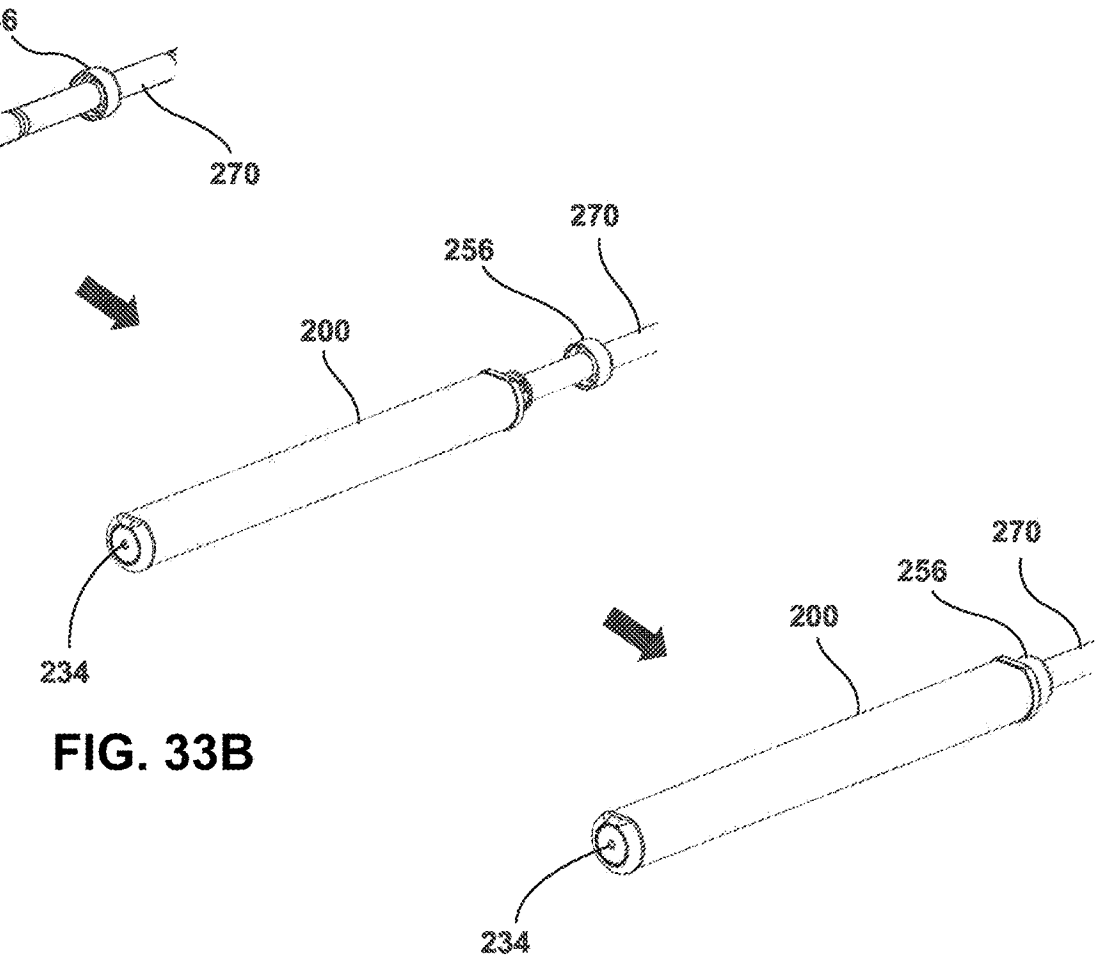
FIGS. 33A-33C includes perspective views of the interchangeable golf club grip of FIG. 22 being installed on a golf club shaft.
Figures 34A, 34B, 34C, 34D:
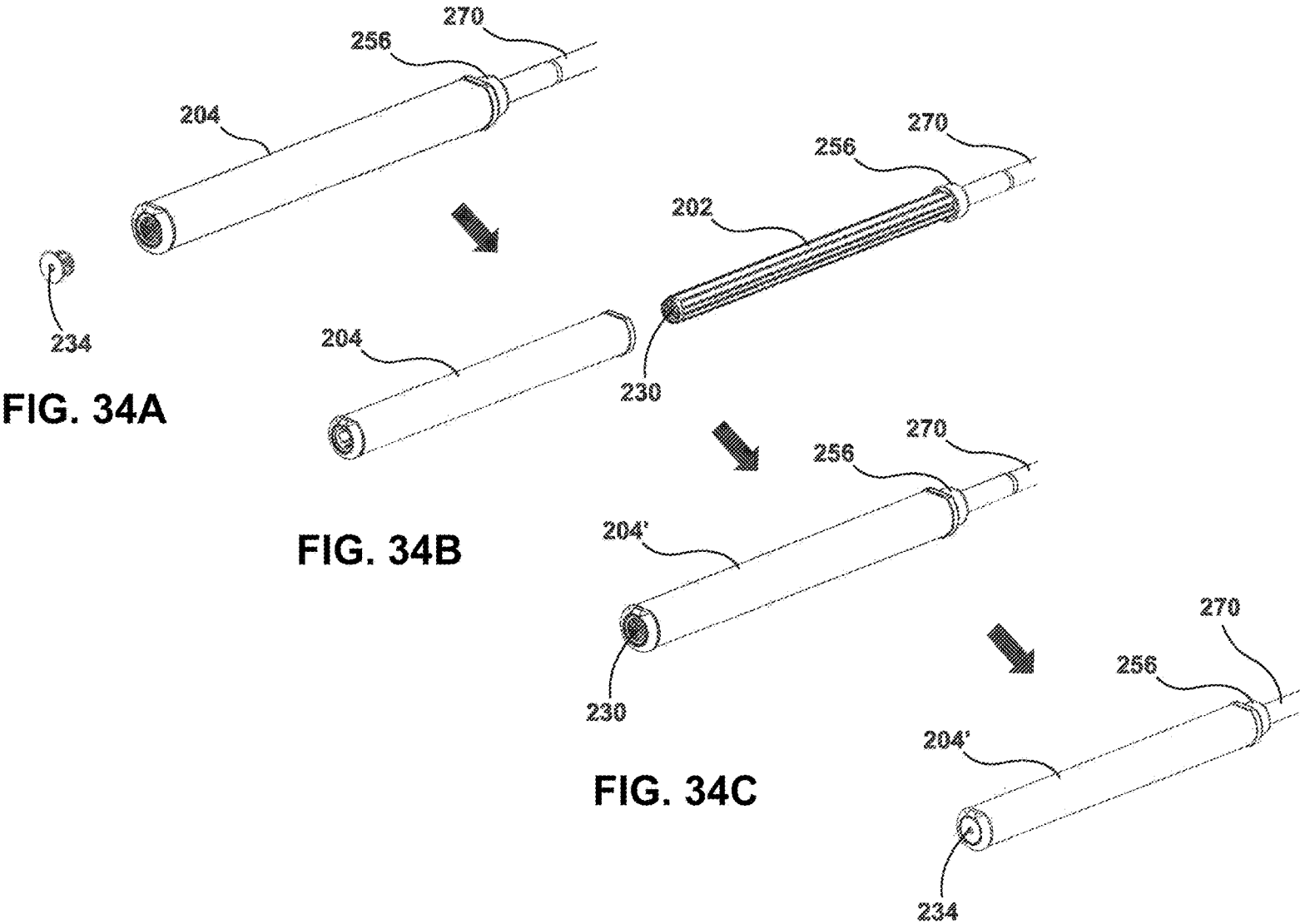
FIGS. 34A-34D includes perspective views of a first golf grip being replaced with a second golf grip in accordance with an embodiment of the present invention.

The interchangeable golf club grip 200 can be attached to a straight or tapered golf club shaft in the following manner. The docking sleeve 256 is loosely inserted over a golf club shaft 270 as shown in FIGS. 33A-C. In some embodiments, an adhesive tape 272 is applied to the upper portion of the golf club shaft 270 and wetted. In other embodiments, adhesive is applied to one or both of the shaft and docking tube, the docking tube is positioned on the shaft, and the adhesive is allowed to cure. Adhesive may allow time to adjust the docking tube on the shaft before the docking tube is fixed relative to the shaft.

The golf club grip 200 is then press-fit onto the taped and wetted upper portion of the golf club shaft 270. As the golf club grip 200 is being press-fit onto the golf club shaft 270, the docking tube 202 engages the golf club shaft 270 and flexes outwardly as the widest portion of the golf club shaft 270 passes through the docking tube 202. Because the docking tube sidewall 212 is elastically deformable, it can accommodate various diameters, including the tapered outer diameter of a golf club shaft. Although described in relation to a tapered shaft, the docking tube 202 can instead be used in connection with straight (nontapered) shafts, if desired.

The docking tube 202 conforms to the outer diameter of the golf club shaft, and the elongated handle 204 is prevented from rotating relative to the docking tube 202. In some embodiments, the elongated handle 204 and docking tube 202 are coupled to the golf club shaft 270 simultaneously. In other embodiments, the docking tube 202 is coupled to the golf club shaft 270 and then the elongated handle 204 is coupled to the docking tube 202. Positioning the elongated handle 204 on the docking tube 202 may include positioning the projection in the channel such that the elongated handle 204 is rotationally fixed relative to the docking tube 202. Positioning the elongated handle 204 on the docking tube 202 may include moving the elongated handle 204 from a first position to a final position. The first position may be where the elongated handle 204 first engages the docking tube 202. The final position may be where the elongated handle 204 is fully positioned on the docking tube 202 and ready for use. The elongated handle 204 may be rotationally fixed relative to the docking tube 202 as the elongated handle 204 is moved from the initial position to the final position.

The weighted end cap 234 is inserted in the threaded insert 230 at the butt end of the golf club grip 200, and the docking sleeve 256 is brought into engagement with either the docking collar 254 or the exposed end of the docking tube 202.

The existing elongated handle 204 can be removed from the docking tube 202 and replaced with a different elongated handle 204. As shown in FIGS. 34A-34D, removal is performed by unscrewing the weighted end cap 234 from the threaded insert 230 and manually retracting the existing handle 204 from the docking tube 202. The elongated handle 204 may remain rotationally fixed relative to the docking tube 202 while the elongated handle 204 is being removed. The docking tube 202 may remain affixed to the golf club shaft 270 when the elongated handle 204 is removed. The replacement handle 204' is then inserted onto the docking tube 202 and guided forward until the ring insert 232 abuts the threaded insert 230. The docking tube 202 and handle 204 may be shaped such that one or more handles can be repeatedly coupled to and detached from the docking tube and returned to the same location relative to the shaft.

The weighted end cap 234 is threaded into the threaded opening in the threaded insert 230, thereby centering the replacement handle 204' on the docking tube 202 and preventing accidental retraction of the replacement handle 204'. The universal docking tube is adapted to fit over a wide variety of golf club shafts and is adapted to receive a wide variety of different-sized handles. For example, the golf club shafts can be straight, tapered, or stepped, and the golf club handles can be narrow, enlarged, pistol-shaped, cylindrical, or rectangular. The underlisting for each golf club handle provides a light interference fit over the universal docking tube and may fit over the universal docking tube in only a single orientation.

Figure 35:
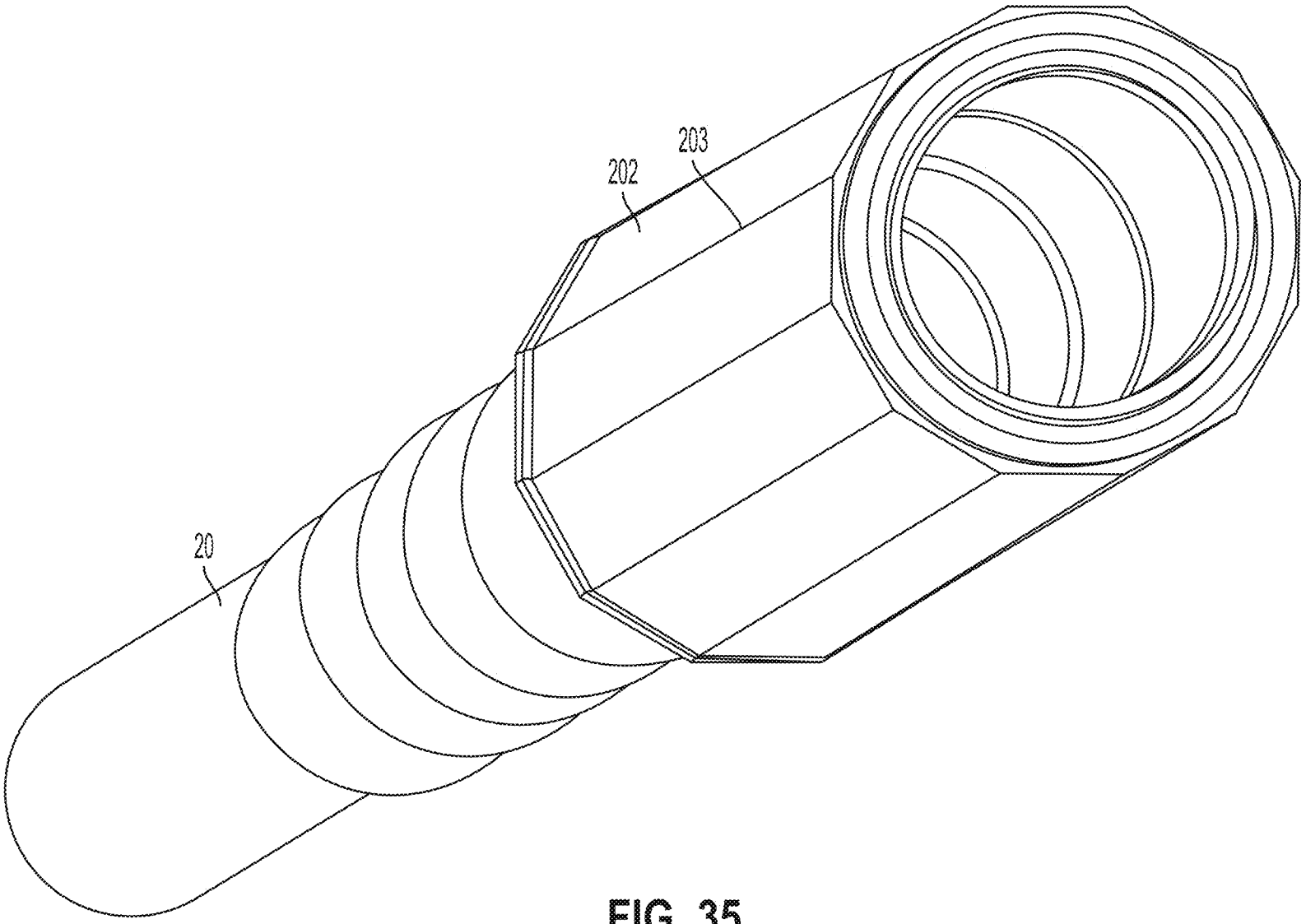
FIG. 35 is a top perspective view of a golf club shaft and docking tube in accordance with another embodiment of the present invention.

Referring to FIG. 35, the docking tube 202 may include a polygon cross-sectional shape. The polygon may have a selected number of sides (e.g., four, six, eight, ten, or twelve). The polygon may have an uneven number of sides or one side may different from another side (e.g., wider or narrower) such that the handle (not shown in FIG. 35) can only be positioned on the docking tube 202 in a single orientation. In some embodiments, the docking tube 202 with a polygon outer shape does not include additional longitudinal ribs 210 or lengthwise projections 214. Instead, the handle may include a similar polygon shaped opening to receive the docking tube 202 such that the polygon shape of the docking tube 202 and handle opening prevents relative rotation between the docking tube 202 and handle. In some such embodiments, the vertices 203 where one side of the docking tube 202 meets another side of the docking tube 202 may serve as ribs or projections because the vertices 203 engage and prevent relative rotation of the handle. In other embodiments, the docking tube 202 with a polygon outer shape includes at least one of longitudinal ribs 210 and lengthwise projections 214. The shaft 20 may include the polygon shape such that the handle can be coupled directly to the shaft 20 and the docking tube may be omitted.

A kit may include the docking tube 202 and at least one handle 204. The kit may include two handles 204 with the first handle having a different design than the second handle. For example, the first handle may be a first color and the second handle may be a second color different from the first color. The first handle may have a different dimension (e.g., length or diameter) than the second handle.

The above description is that of current embodiments of the invention. Various alterations and changes can be made without departing from the spirit and broader aspects of the invention as defined in the appended claims, which are to be interpreted in accordance with the principles of patent law, including the doctrine of equivalents. This disclosure is presented for illustrative purposes and should not be interpreted as an exhaustive description of all embodiments of the invention or to limit the scope of the claims to the specific elements illustrated or described in connection with these embodiments. The present invention is not limited to only those embodiments that include all of these features or that provide all of the stated benefits, except to the extent otherwise expressly set forth in the issued claims. Any reference to claim elements in the singular—for example, using the articles "a," "an," "the" or "said"—is not to be construed as limiting the element to the singular.

The invention claimed is:

1. A golf club grip for use with a shaft, the shaft having a first end and a second end opposite the first end, the golf club grip comprising:

an elongated handle formed of ethylene-vinyl acetate, ethylene-vinyl acetate coated with polyurethane, foam rubber, polypropylene foam, polyethylene foam, and/or rubber, the elongated handle including an elongated handle sidewall defining an axial opening configured to receive a docking tube of the shaft, a docking tube configured to couple to a first end of a shaft and comprising a sidewall having plurality of projections and a plurality of ribs, wherein a radius of curvature of each rib of the plurality of ribs is smaller than a radius of curvature of each projection of the plurality of projections, wherein the sidewall of the docking tube comprises intermediate sections formed between adjacent projections, wherein the elongated handle sidewall comprises a plurality of channels each having an endwall, wherein at least one of the plurality of channels is configured to receive a projection of the plurality of projections and a rib of the plurality of ribs to rotationally lock the elongated handle relative to the docking tube when the elongated handle is coupled to the docking tube, and wherein the intermediate sections define a radius of curvature that is greater than a radius of curvature of the plurality of projections, and wherein, when the elongated handle and the docking tube are coupled, the intermediate sections of the docking tube contact the sidewall elongated handle and a gap is formed between an end of the projection and the endwall of the channel.

2. The golf club grip of claim 1, wherein, when the elongated handle is sliding relative to the docking tube, the elongated handle remains rotationally fixed relative to the docking tube.

3. The golf club grip of claim 1 wherein the elongated handle includes an underlisting and an outer gripping surface.

4. A golf grip assembly for a golf club shaft comprising:

a docking tube configured to form a unitary construct with the golf club shaft and formed of at least one of a metal, a composite material, and a metal alloy;

an elongated handle detachably couplable to the docking tube and formed of at least one of ethylene-vinyl acetate, ethylene-vinyl acetate coated with polyurethane, foam rubber, polypropylene foam, polyethylene foam, and/or rubber, the elongated handle including an elongated handle sidewall defining an axial opening configured to receive the docking tube, wherein the docking tube includes a plurality of projections and a plurality of ribs, and the elongated handle sidewall includes a plurality of channels, wherein a radius of curvature of each rib of the plurality of ribs is smaller than a radius of curvature of each projection of the plurality of projections, wherein each channel of the plurality of channels is configured to receive a projection of the plurality of projections and a rib of the plurality of ribs to rotationally lock the elongated handle relative to the docking tube when the elongated handle is coupled to the docking tube, wherein the docking tube comprises intermediate sections formed between adjacent projections of the plurality of projections, wherein the intermediate sections define a radius of curvature that is greater than a radius of curvature of the plurality of projections, and wherein, when the elongated handle is coupled to the docking tube, a gap is formed between an end of each projection of the plurality of projections and an endwall of each channel of the plurality of channels.

5. The golf grip assembly of claim 4, wherein the docking tube includes a polygonal cross sectional shape, and wherein the axial opening of the elongated handle has a corresponding polygonal cross-sectional shape to receive the docking tube.

6. The golf grip assembly of claim 5, wherein the polygonal cross sectional shape comprises one side that is wider or narrower than another side such that the elongated handle is configured to be positioned on the docking tube in a single orientation.

7. The golf grip assembly of claim 5, wherein the projection is disposed at a vertex of the polygonal cross-sectional shape.

8. The golf grip assembly of claim 4, wherein the docking tube includes an internally threaded portion, and wherein the elongated handle further includes an end cap assembly configured to be threaded into the internally threaded portion of the docking tube.

9. The golf grip assembly of claim 8, wherein the end cap assembly includes a threaded insert including a shank having external threads, a shank head that is wider than the shank, and an internally threaded bore.

10. The golf grip assembly of claim 8 further including a ring insert positionable within an opening in an end of the elongated handle.

11. The golf grip assembly of claim 10 wherein the ring insert includes an engagement surface configured to engage the end cap assembly.

12. The golf grip assembly of claim 11 wherein the ring insert includes a chamfered annular surface opposite the engagement surface.

13. The golf grip assembly of claim 4 wherein the elongated handle includes a plurality of channels, the plurality of channels being disposed in a radially asymmetric arrangement about a centerline axis of the axial opening.

* * * * *